US007147021B2

(12) United States Patent
Dupont et al.

(10) Patent No.: US 7,147,021 B2
(45) Date of Patent: Dec. 12, 2006

(54) SYSTEM FOR TRANSFER OF A FLUID PRODUCT, PARTICULARLY LIQUEFIED NATURAL GAS, BETWEEN A TRANSPORT VEHICLE, SUCH AS A SHIP, AND AN INSTALLATION FOR RECEIVING OR SUPPLYING THIS PRODUCT

(75) Inventors: Bernard Dupont, Eaubonne (FR); Stéphane Paquet, Paris (FR)

(73) Assignee: Societe Europeenne d'Ingenierie Mecanique-Eurodim, Rueil Malmaison (FR)

( * ) Notice: Subject to any disclaimer, the term of this patent is extended or adjusted under 35 U.S.C. 154(b) by 136 days.

(21) Appl. No.: 10/477,219

(22) PCT Filed: May 13, 2002

(86) PCT No.: PCT/FR02/01603

§ 371 (c)(1),
(2), (4) Date: Apr. 7, 2004

(87) PCT Pub. No.: WO02/092494

PCT Pub. Date: Nov. 21, 2002

(65) Prior Publication Data

US 2004/0154697 A1 Aug. 12, 2004

(30) Foreign Application Priority Data

May 11, 2001 (FR) ..... 01 06279

(51) Int. Cl.
*B65B 1/04* (2006.01)

(52) U.S. Cl. ..... 141/382; 141/82; 141/279; 141/387; 141/388; 441/5; 114/230.14; 114/230.25

(58) Field of Classification Search ..... 141/1, 141/2, 18, 82, 279, 387, 388, 382; 114/230.14, 114/230.25, 230.1; 137/615, 236.1; 441/3–5
See application file for complete search history.

(56) References Cited

U.S. PATENT DOCUMENTS

| | | | | |
|---|---|---|---|---|
| 2,922,446 | A | 1/1960 | Sheiry | |
| 3,349,816 | A * | 10/1967 | Mowell et al. | 141/387 |
| 4,090,538 | A * | 5/1978 | Kotcharian | 141/100 |
| 4,261,398 | A | 4/1981 | Haley | |
| 6,623,043 | B1 * | 9/2003 | Pollack | 285/121.2 |
| 6,637,479 | B1 * | 10/2003 | Eide et al. | 141/387 |

* cited by examiner

*Primary Examiner*—Timothy L. Maust
(74) *Attorney, Agent, or Firm*—Leydig, Voit & Mayer, Ltd.

(57) ABSTRACT

A device for transferring a product between a ship and a fixed installation. The device is supported at one end by a support structure and the other end is capable of being connected to the ship's manifold. The support structure includes a boom carrying a transfer pipe, rotatable about a vertical axis above the ship, and a deformable transfer device, one end of which is connected to the pipe, and the other end is mobile between a stowed position proximate the boom and a position for connection to the ship's manifold. The invention is useful for transferring liquefied natural gas.

28 Claims, 17 Drawing Sheets

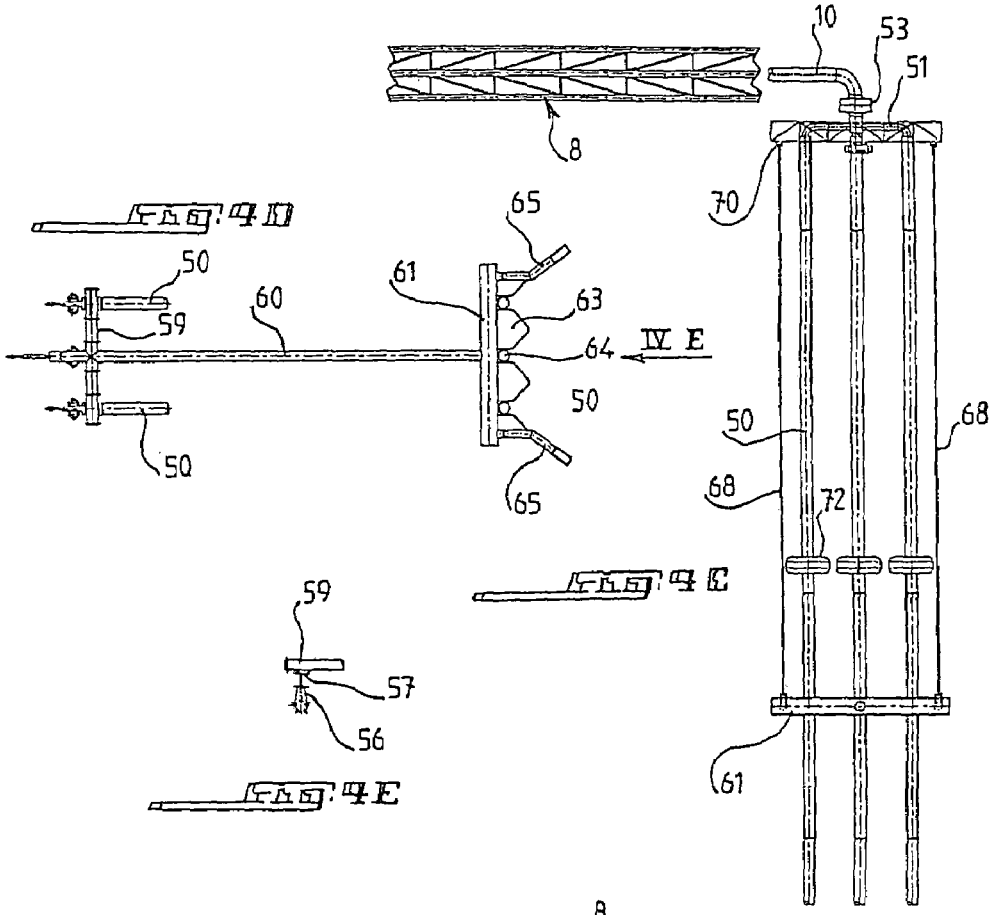
FIG. 4D
FIG. 4E
FIG. 4E
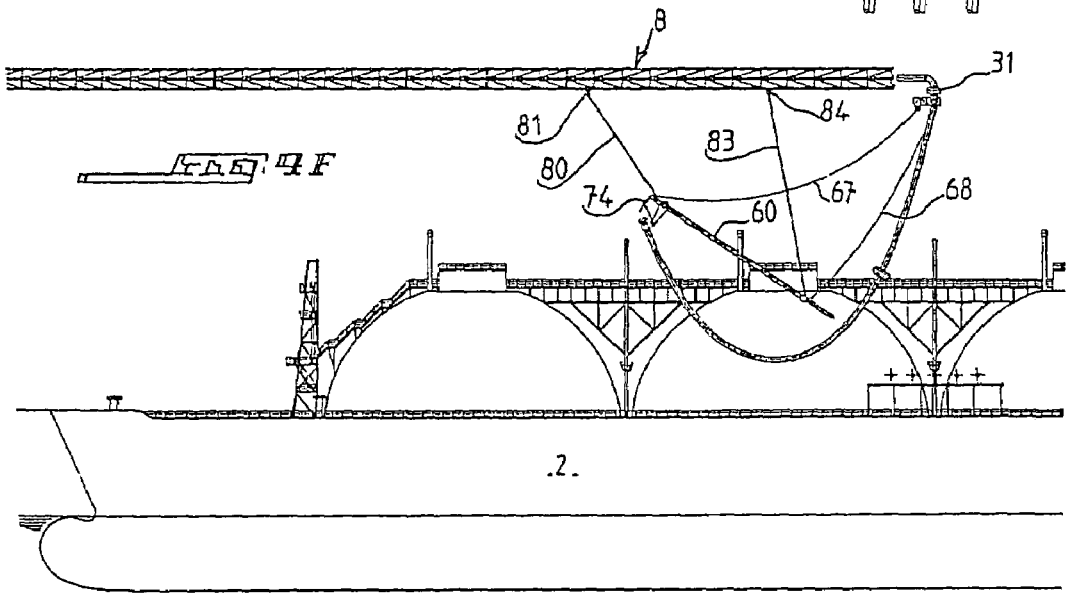
FIG. 4F

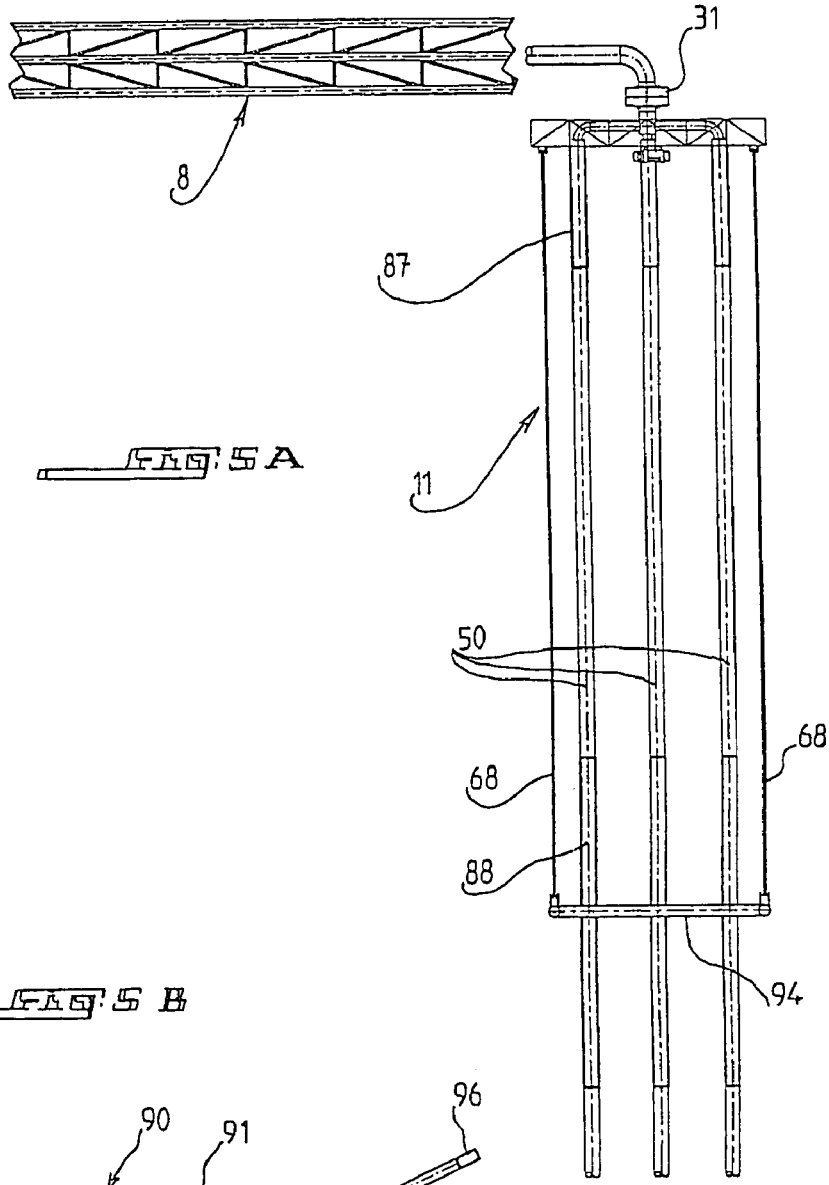
FIG. 5A
FIG. 5B
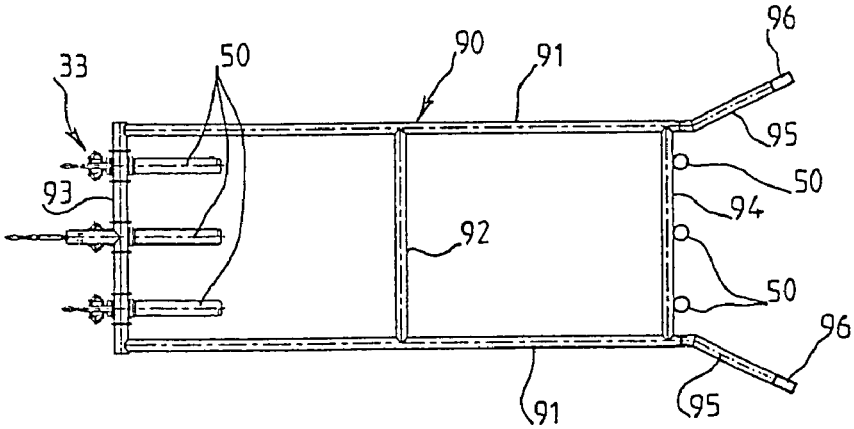

SYSTEM FOR TRANSFER OF A FLUID PRODUCT, PARTICULARLY LIQUEFIED NATURAL GAS, BETWEEN A TRANSPORT VEHICLE, SUCH AS A SHIP, AND AN INSTALLATION FOR RECEIVING OR SUPPLYING THIS PRODUCT

FIELD OF THE INVENTION

The invention relates to a system for transfer of a fluid product, particularly a liquefied natural gas, between a transport vehicle, such as a ship, and an installation for receiving this product or supplying the ship with this product, which has a device for transferring the product between the ship and the installation, that is supported at a first end by a support structure and has a second end that can be connected to a manifold device of the vehicle.

BACKGROUND

Known transfer systems for the transfer of liquefied natural gas are not suitable for use under severe environmental conditions.

The present invention offers a system that eliminates the above-mentioned disadvantage of known systems.

SUMMARY OF THE INVENTION

To attain this aim, the transfer system according to the invention has a the support structure with a carrier boom for a rigid transfer pipe that is mounted on a mooring post, rotating around a vertical axis above a transport vehicle, and a deformable transfer device, a first end of which is connected to the transfer pipe, and a second end that can be moved between a storage position near the boom and a position of connection to a manifold device of a ship.

According to one feature of the invention, the deformable transfer device is connected to the fixed transfer pipe at the free end of the boom, and the connection of the deformable transfer device to the fixed transfer pipe suspends the deformable transfer device from the boom.

According to another feature of the invention, the mooring post is a single mooring point, and the vehicle can turn freely about the mooring post in order to orient itself in the direction of the elements (swell, wind, current).

According to another feature of the invention, the boom is carried along by the ship by the deformable transfer device when the transfer device is connected to the manifold of the ship.

According to yet another feature of the invention, when the deformable transfer device is not connected to the manifold, the boom is free to orient itself in the direction of the wind in order to resist storms under survival conditions.

According to yet another feature of the invention, braking means in the boom rotational system to avoid an excessive number of small movements.

According to yet another of the invention, the boom and deformable transfer device are configured such that the stresses exerted on the boom pass through its neutral axis so that the boom is subjected only to simple bending.

According to yet another feature of the invention, the deformable transfer device filters the ship movements so that small movements of the ship around its average position do not generate sufficient lateral stress to lead to rotation of the boom, and the device absorbs high frequency movements and avoids stress peaks.

According to yet another feature of the invention, the deformable transfer device is stored under the boom while oriented parallel to the axis of the boom, and is connected to the fixed pipe by a rotating joint that makes possible a rotation into a position perpendicular to the longitudinal axis of ship during establishment of a connection to the manifold of the ship.

According to yet another feature of the invention, the deformable transfer device has, at its free end, a device for connection to the manifold of the ship.

According to yet another feature of the invention, the connection device and the manifold of the ship have means for centering during dynamic connection of the transfer device to the manifold.

According to yet another feature of the invention, the deformable transfer device has a number of pairs of transfer arms, free ends of the inner arms are connected to a shared part connected to the fixed pipe by the rotating joint, and outer arms carrying connectors.

According to yet another feature of the invention, the deformable transfer device has at least one pair of tubular arms which are articulated to one another, namely an inner arm connected to the fixed pipe and an outer arm that carries a connector at a free end.

According to yet another feature of the invention, the deformable transfer device has at least one cryogenic hose that is connected to an end of the fixed transfer pipe and another end carries a connecting device.

According to yet another feature of the invention, the cryogenic hose in a storage position is suspended under the boom at the end that carries the connector and extends as a chain.

According to yet another feature of the invention, a stand-off arm are associated with the cryogenic hose maintains a predetermined separation between the ship and the boom during the transfer of fluid and/or a predetermined radius of curvature of the hose during connection/disconnection.

According to yet another feature of the invention, stand-off arm is connected to the manifold of the ship during transfer of fluid.

According to yet another feature of the invention, the deformable transfer device has a number of cryogenic hoses joined at first ends that are connected to the fixed pipe, and each of which carries a connector at a free end.

According to yet another feature of the invention, the stand-off arm is suspended under the boom by a connecting component, such as a cable or a connecting rod, to form a balance beam that ensures that a predetermined distance between the ship and the boom is maintained during transfer of fluid and that reduces or cancels the stresses exerted on the connectors or manifolds during establishment of a connection and during transfer.

BRIEF DESCRIPTION OF DRAWING FIGURES

The invention will be better understood, and other aims, characteristics, details and advantages of it will appear more clearly in the following explanatory description given with reference to the appended diagrammatic drawings, given only as examples, illustrating several embodiments of the invention, and in which.

Figure 3A:
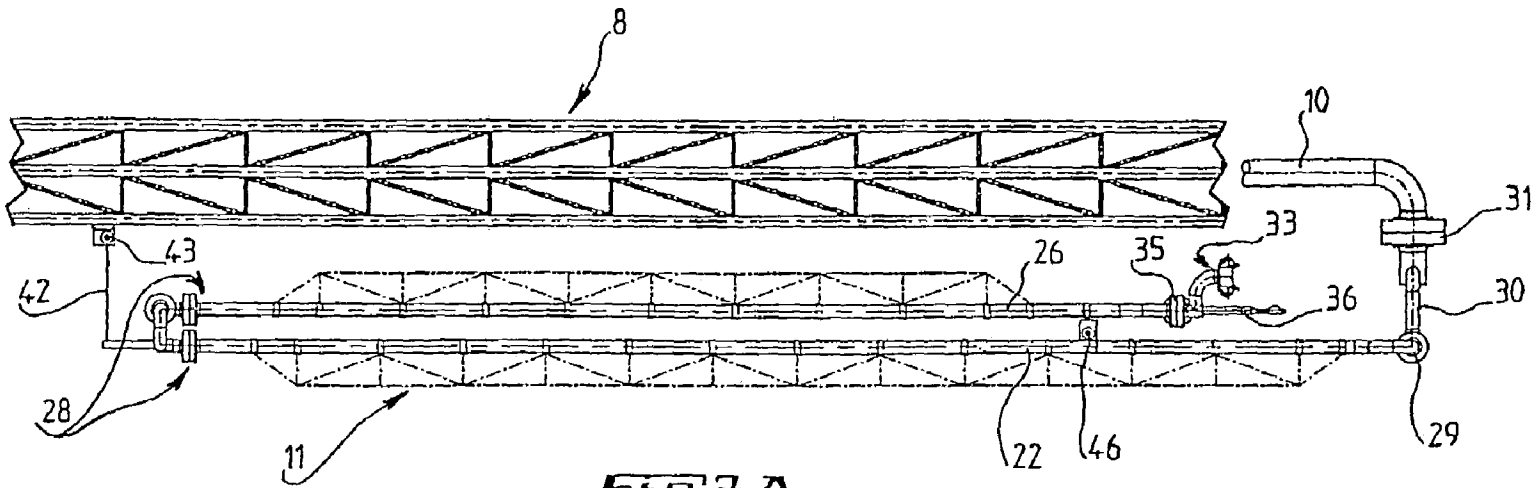
FIG. 3A is a view, partially cut-away, on a larger scale, in the direction of arrow III A of FIG. 2, and illustrates a first embodiment of a deformable transfer device, in its storage position under the support boom.

Each of FIGS. 3D to 3I illustrates a step in the process of connection of the transfer device according to FIG. 3A to the manifold of the ship.

Figure 2:
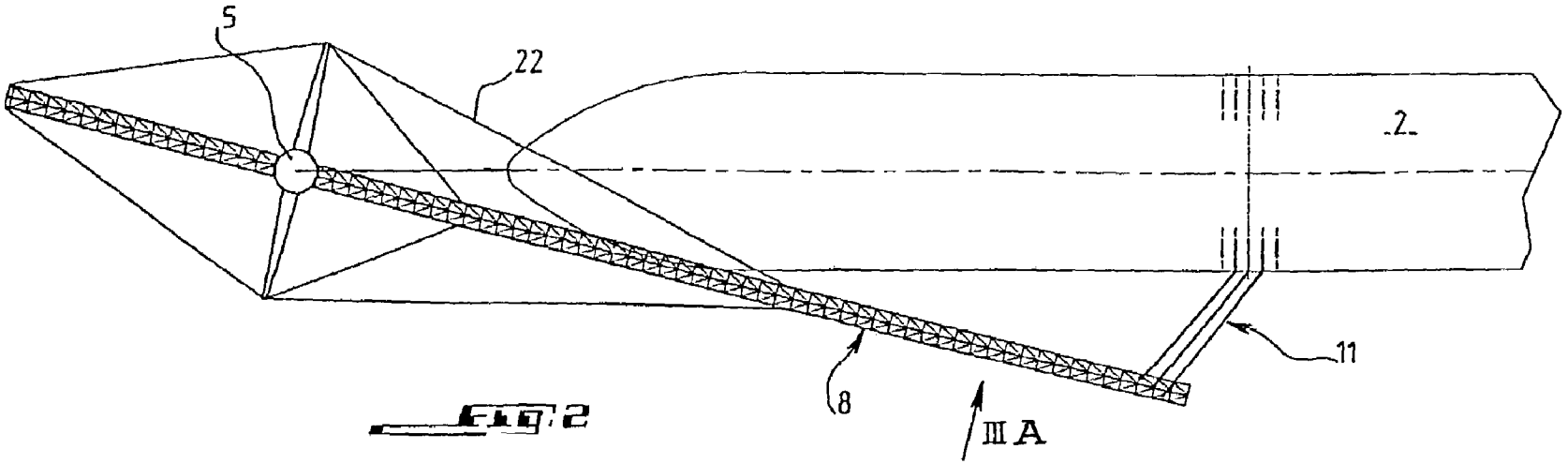
FIG. 2 is a diagrammatic top view of the system according to FIG. 1.
Figures 3, 4, 5:
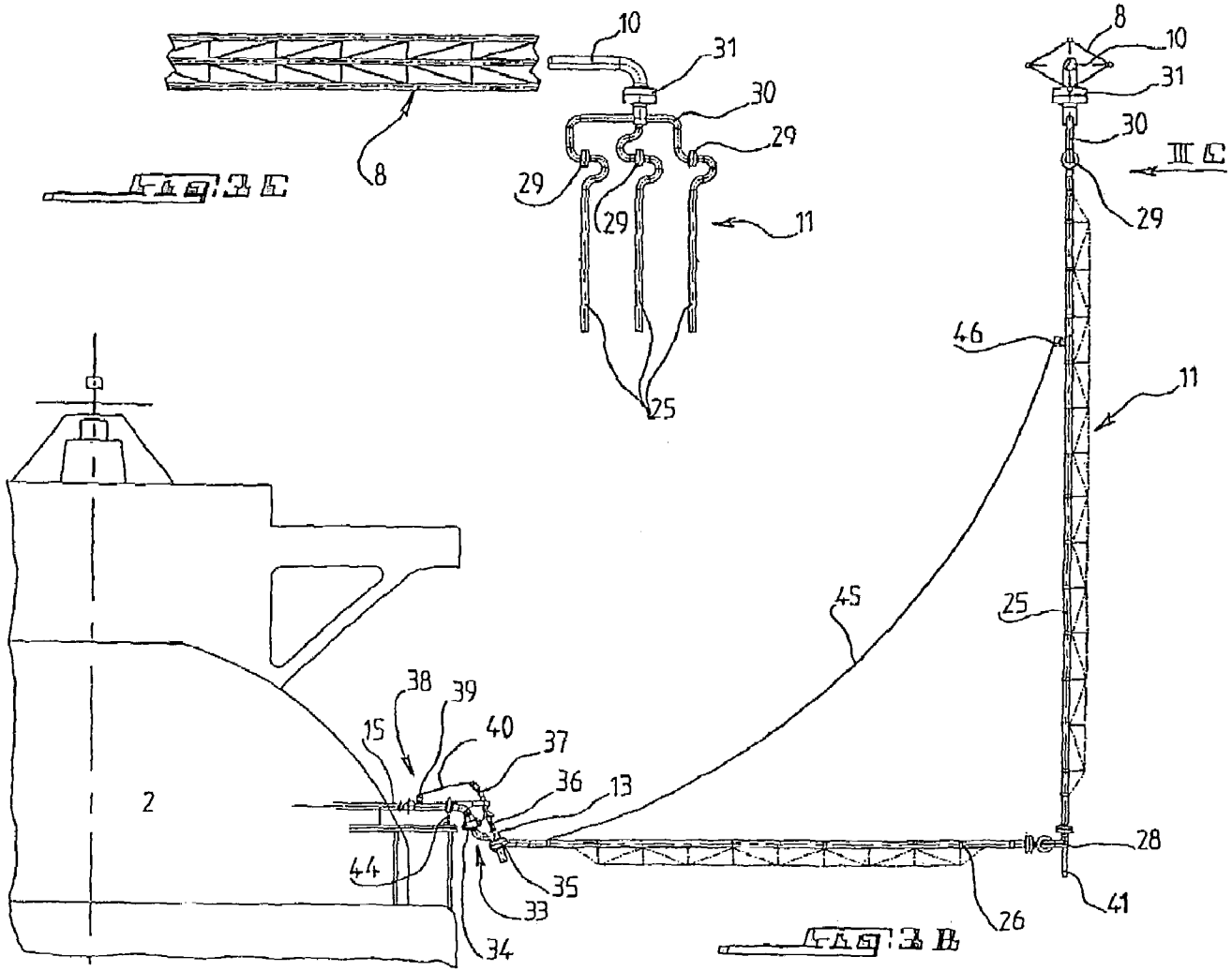
FIG. 3B shows the transfer device according to FIG. 3A in its position of connection to the manifold of the ship.
FIG. 3C is a partial view in the direction of arrow III C of FIG. 3B.
Figure 3D:
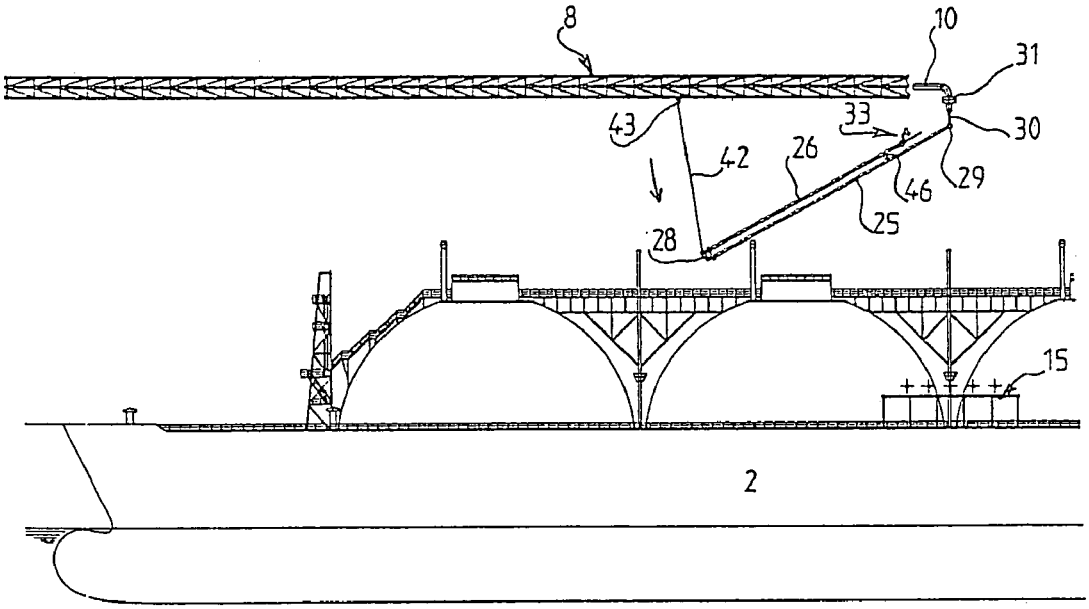
Figure 3E:
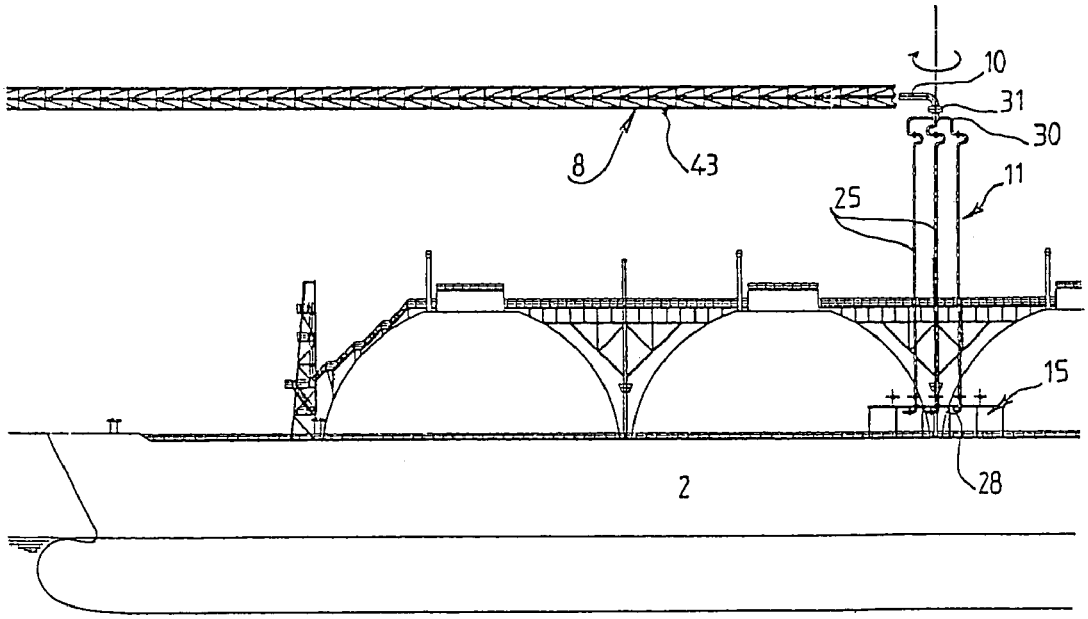
Figure 4A:
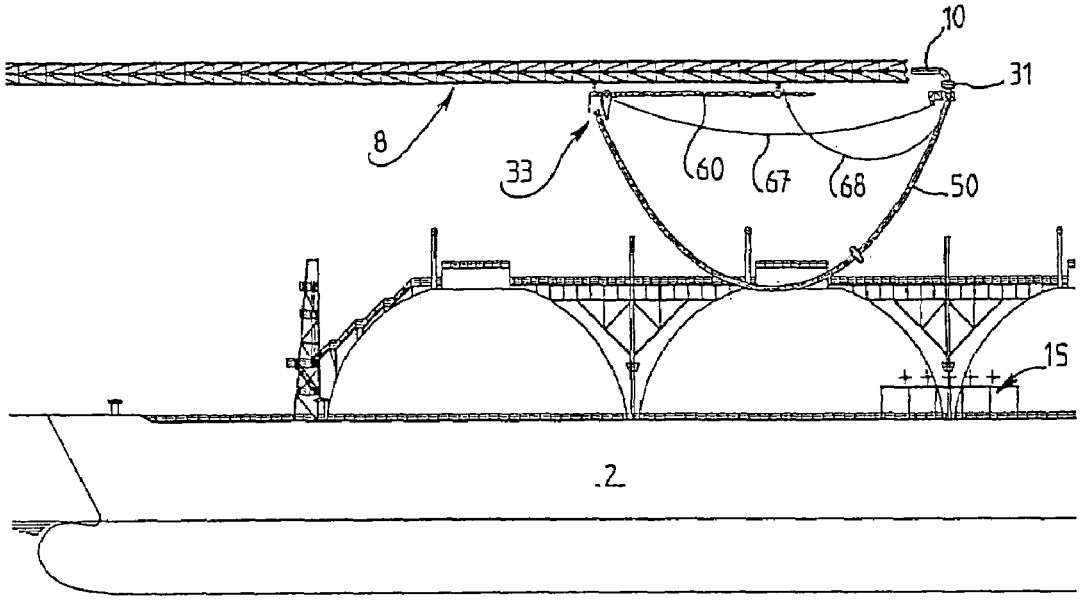
Figure 4B:
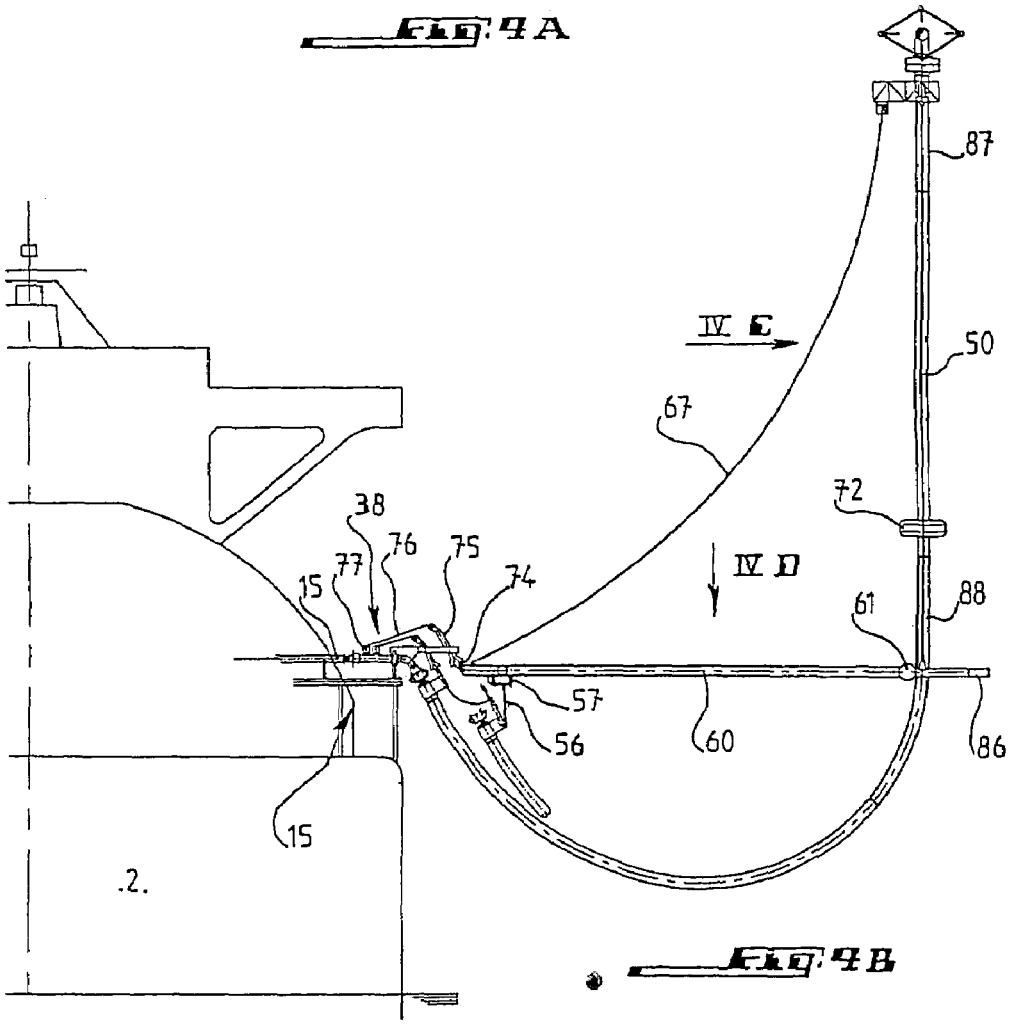
Figure 4G:
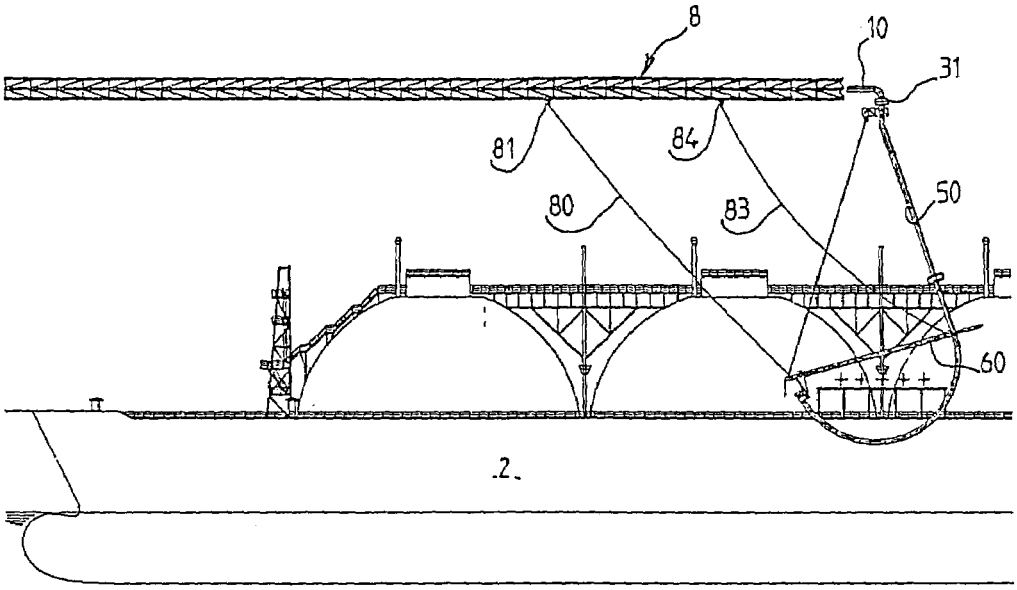
Figure 4H:
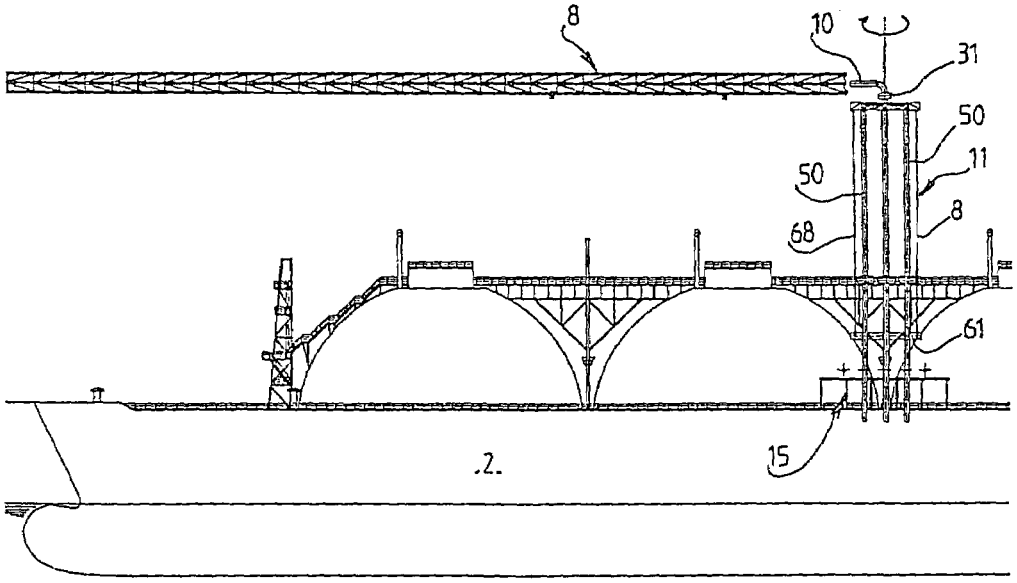
Figure 8K:
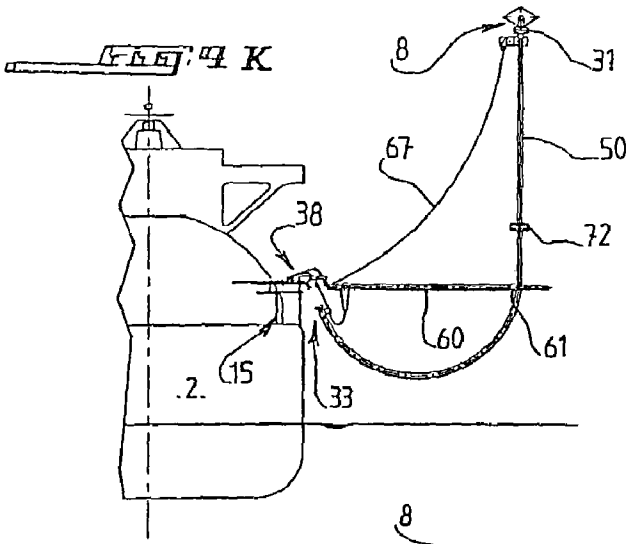
Figure 8L:
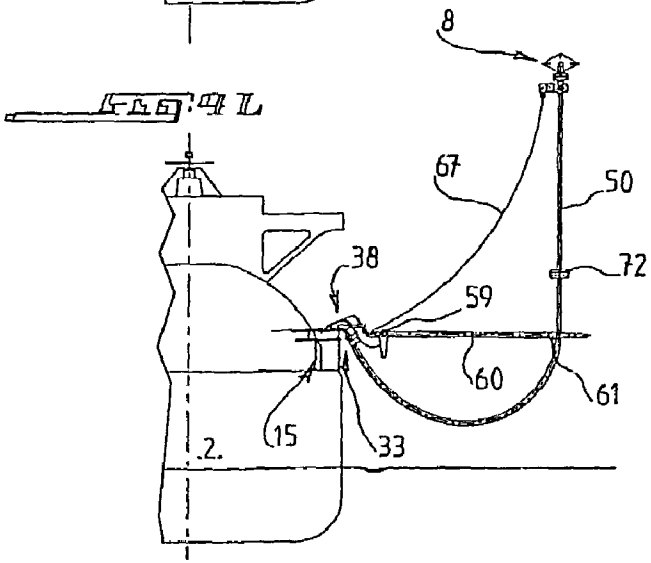
Figure 8I:
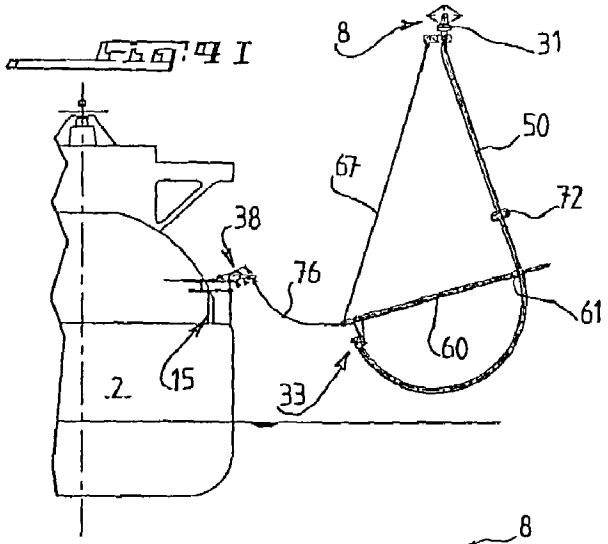
Figure 8J:
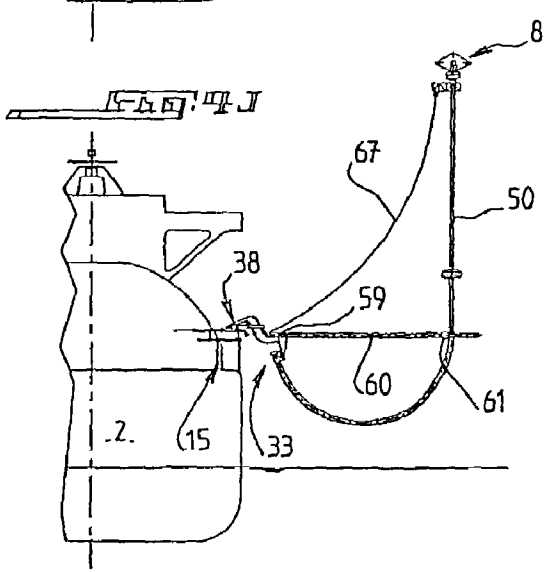
Figure 4O:
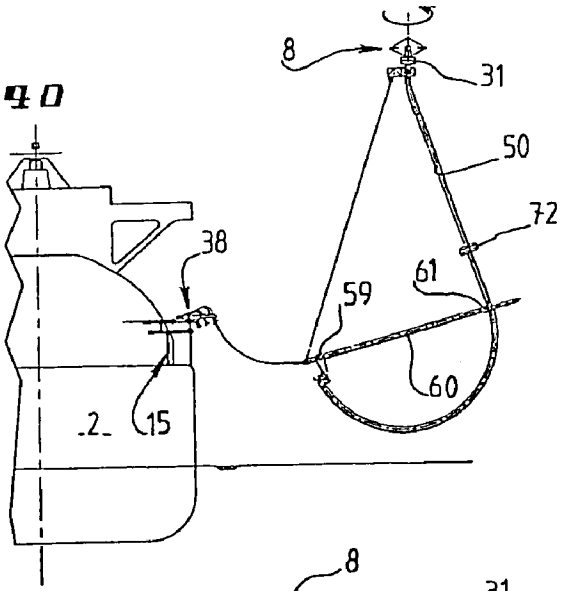
Figure 4P:
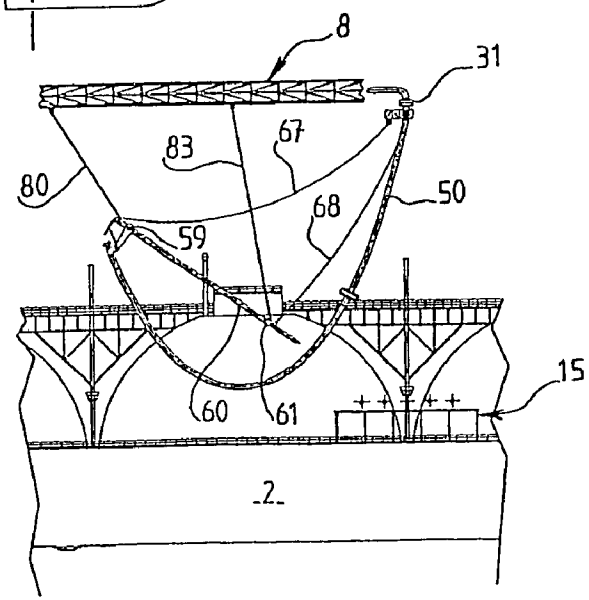
Figure 4M:
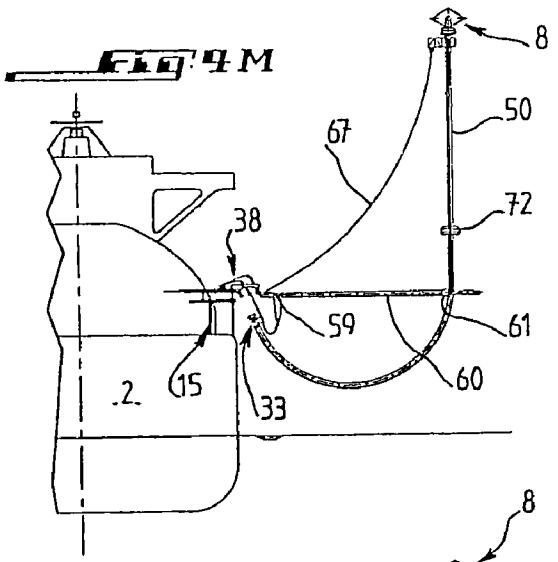
Figure 4N:
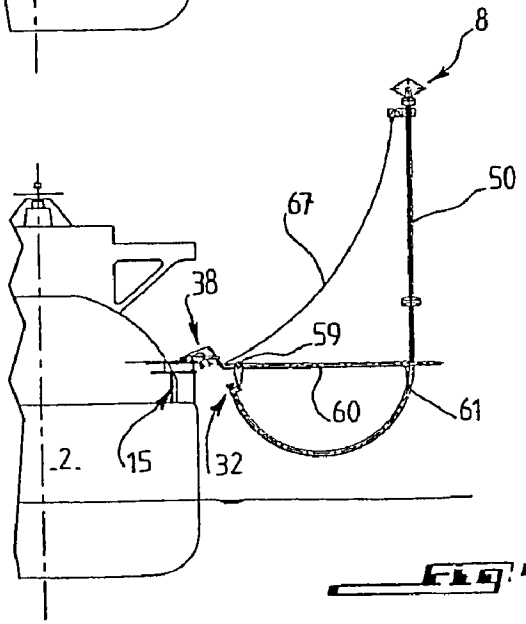
Figures 6A, 6B, 6E:
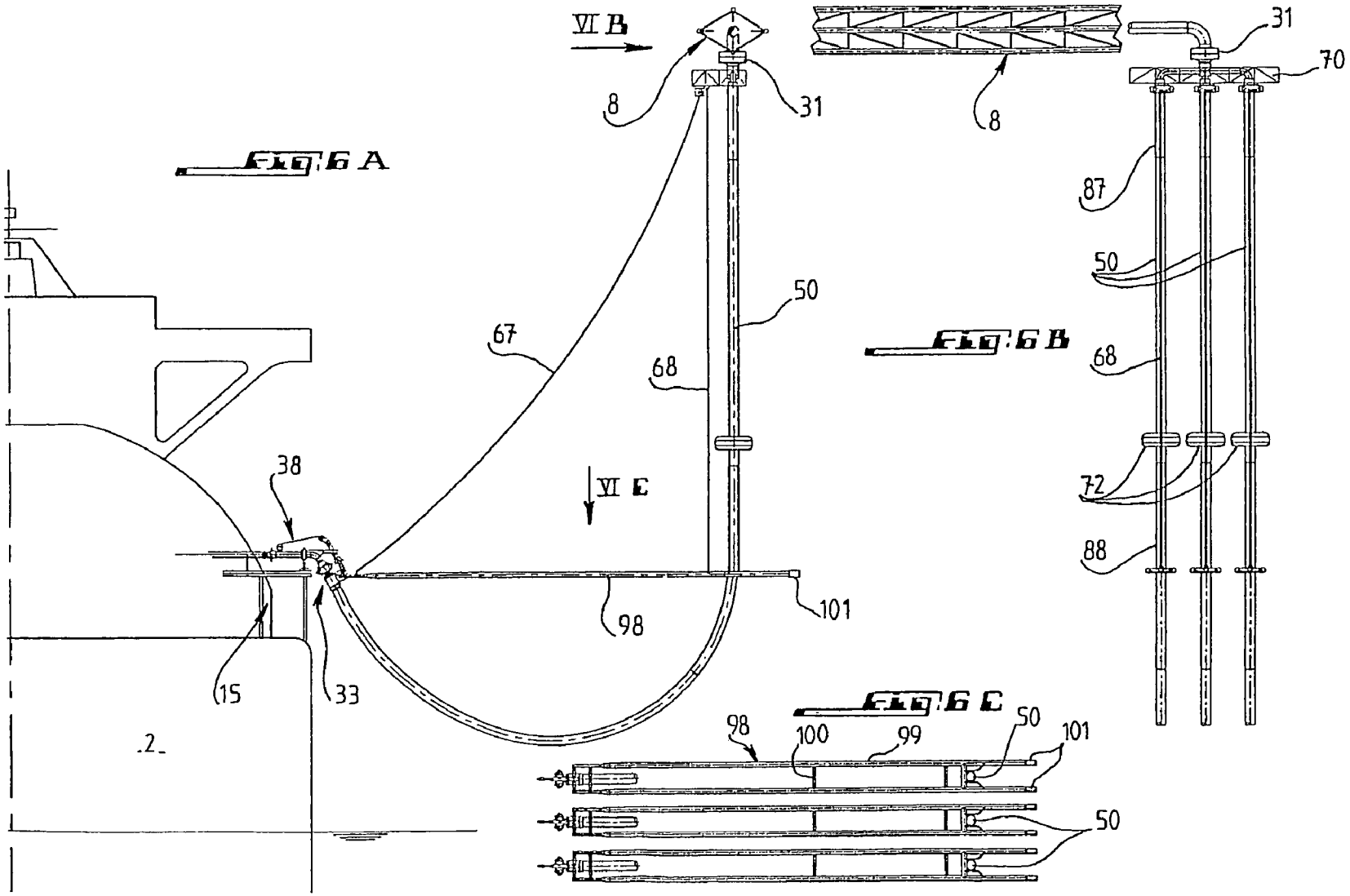
Figure 7:
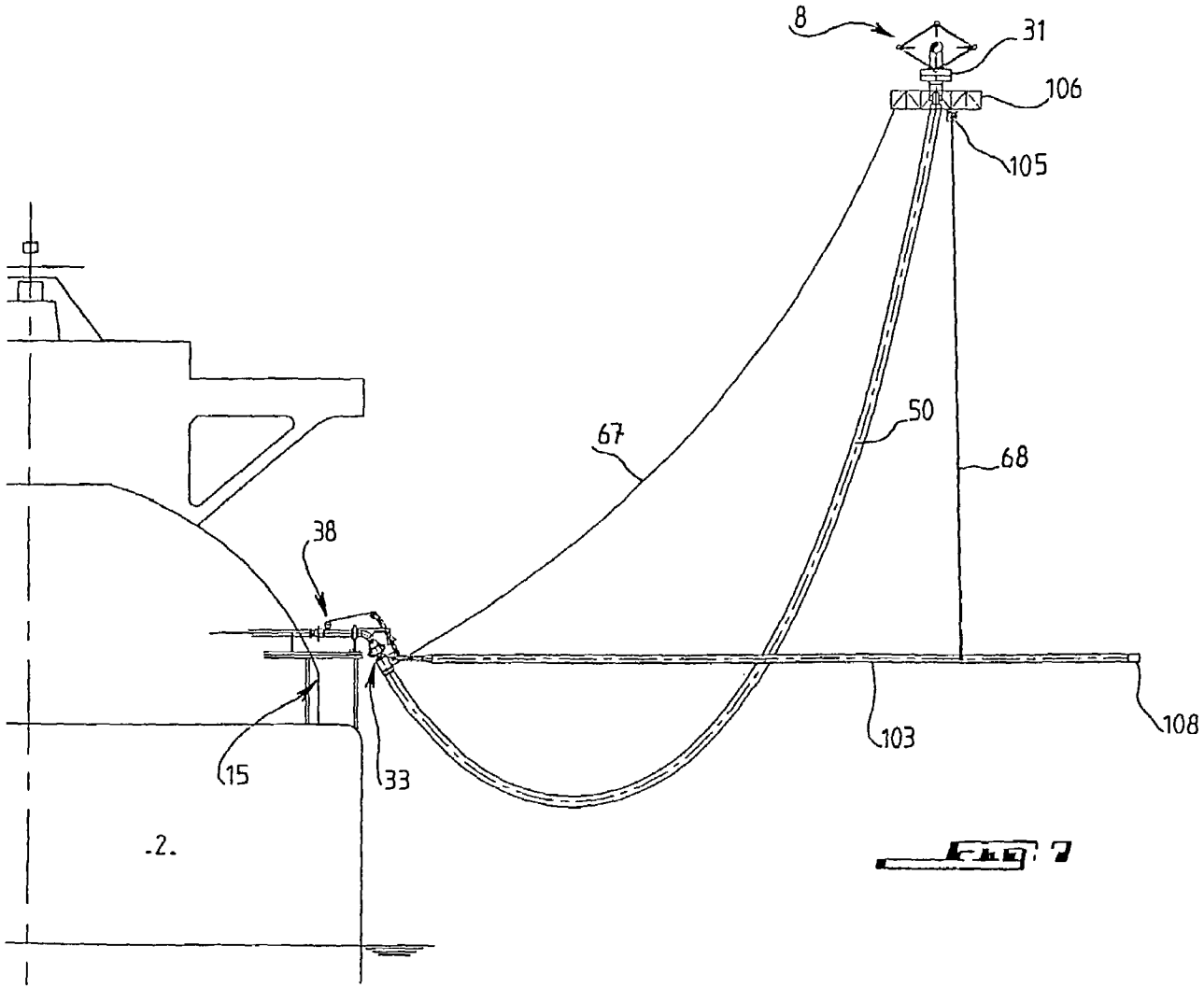
Figure 8A:
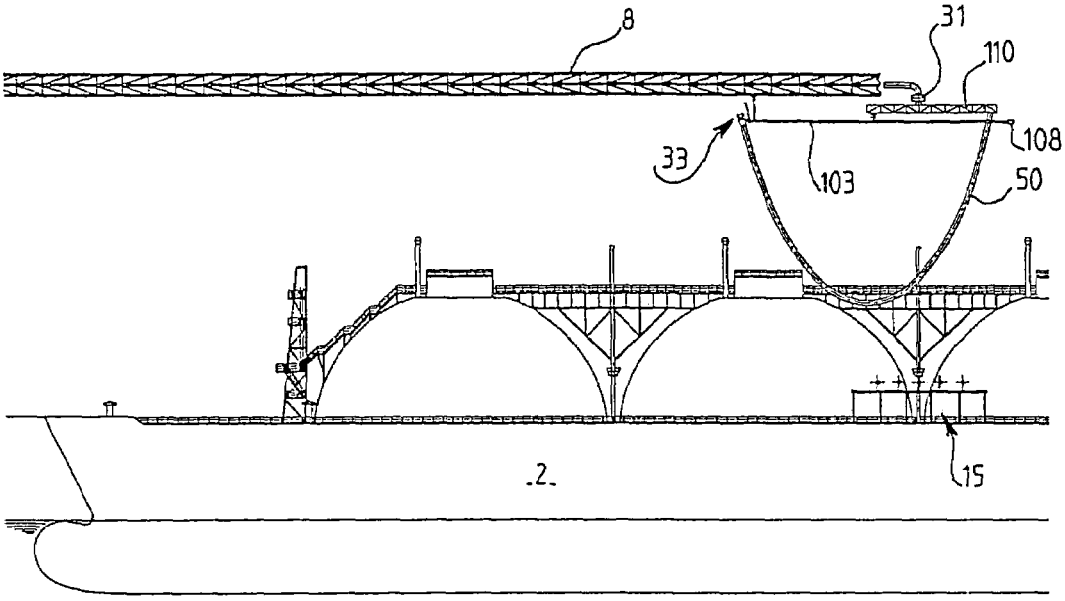
Figure 8B:
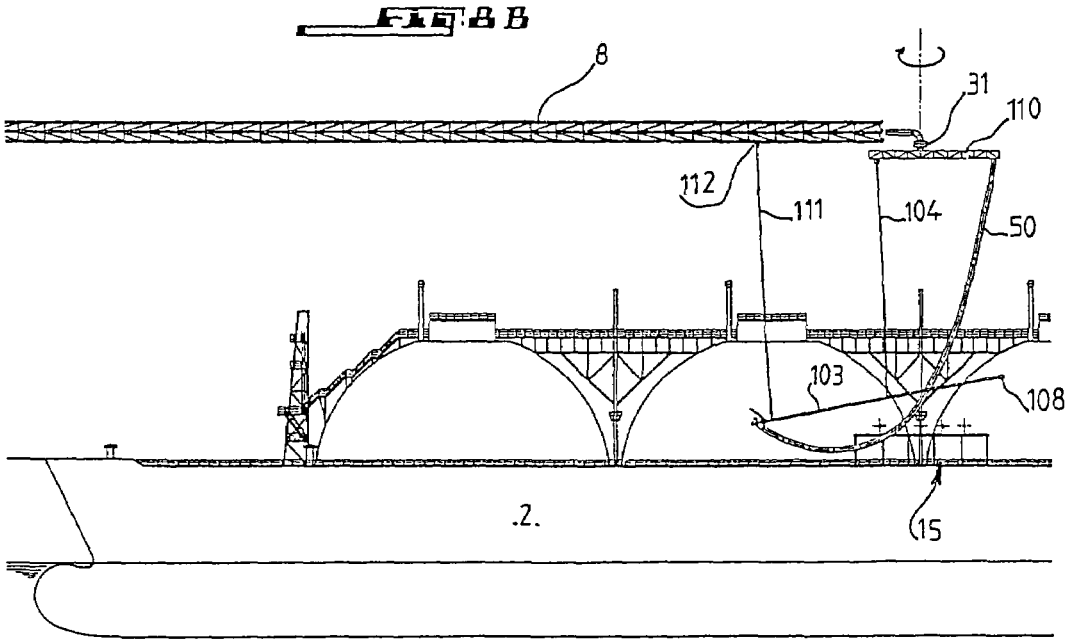
Figure 4C:
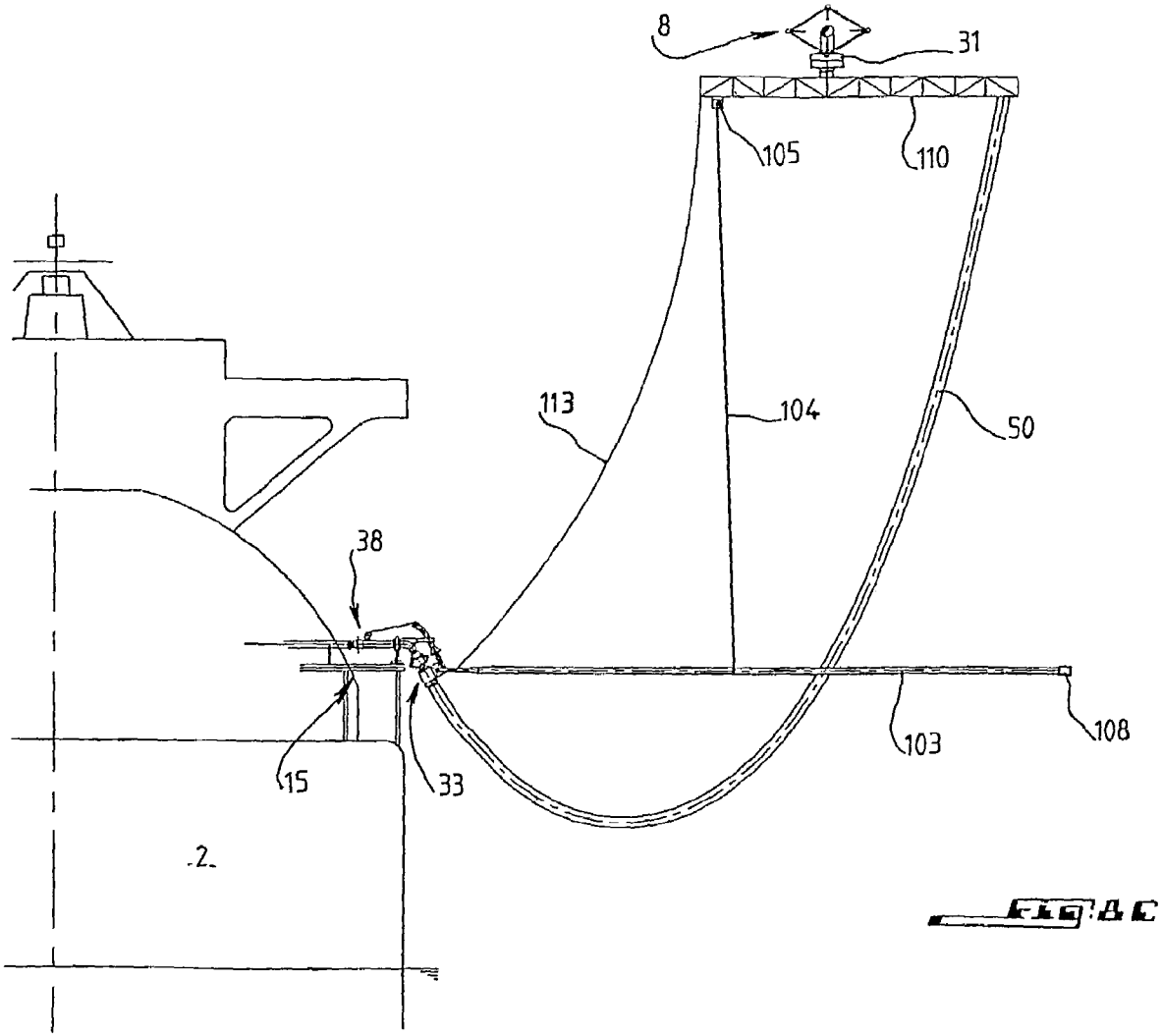

FIG. 4A is a view in the direction of arrow III A of FIG. 2 of a second embodiment of the deformable transfer device according to the invention, in its storage position under the boom;

FIG. 4B shows the transfer pipe device according to FIG. 4A in its position of connection to the ship;

FIG. 4C is a view in the direction of arrow IV C of FIG. 4B;

FIG. 4D is a view in the direction of arrow IV D of FIG. 4B;

FIG. 4E is a partial view in the direction of arrow IV E of FIG. 4D;

Each of FIGS. 4F to 4L illustrates a phase in the process of connection of the transfer device according to FIG. 4A to the ship;

Each of FIGS. 4M to 4P illustrates a step in the process of disconnection of the transfer device according to FIG. 4A from the ship;

FIGS. 5A and 5B are views similar to the views 4B and 4C of another embodiment of the transfer device according to FIG. 4A;

FIG. 6A is a diagrammatic view of a third embodiment of the deformable transfer device according to the invention, in its position of connection to the ship;

FIGS. 6B and 6C, respectively, are views in the directions of arrows VI B and VI C of FIG. 6A;

FIG. 7 is a view similar to that of FIG. 6A of a variant of embodiment of the transfer pipe device according to this figure;

FIG. 8A is a view in the direction of arrow III A of FIG. 2 of another embodiment of the transfer pipe device according to the invention;

FIG. 8B illustrates the transfer pipe device according to FIG. 8A in an intermediate position during its connection to the ship.

Figures 9A, 9B, 9C:
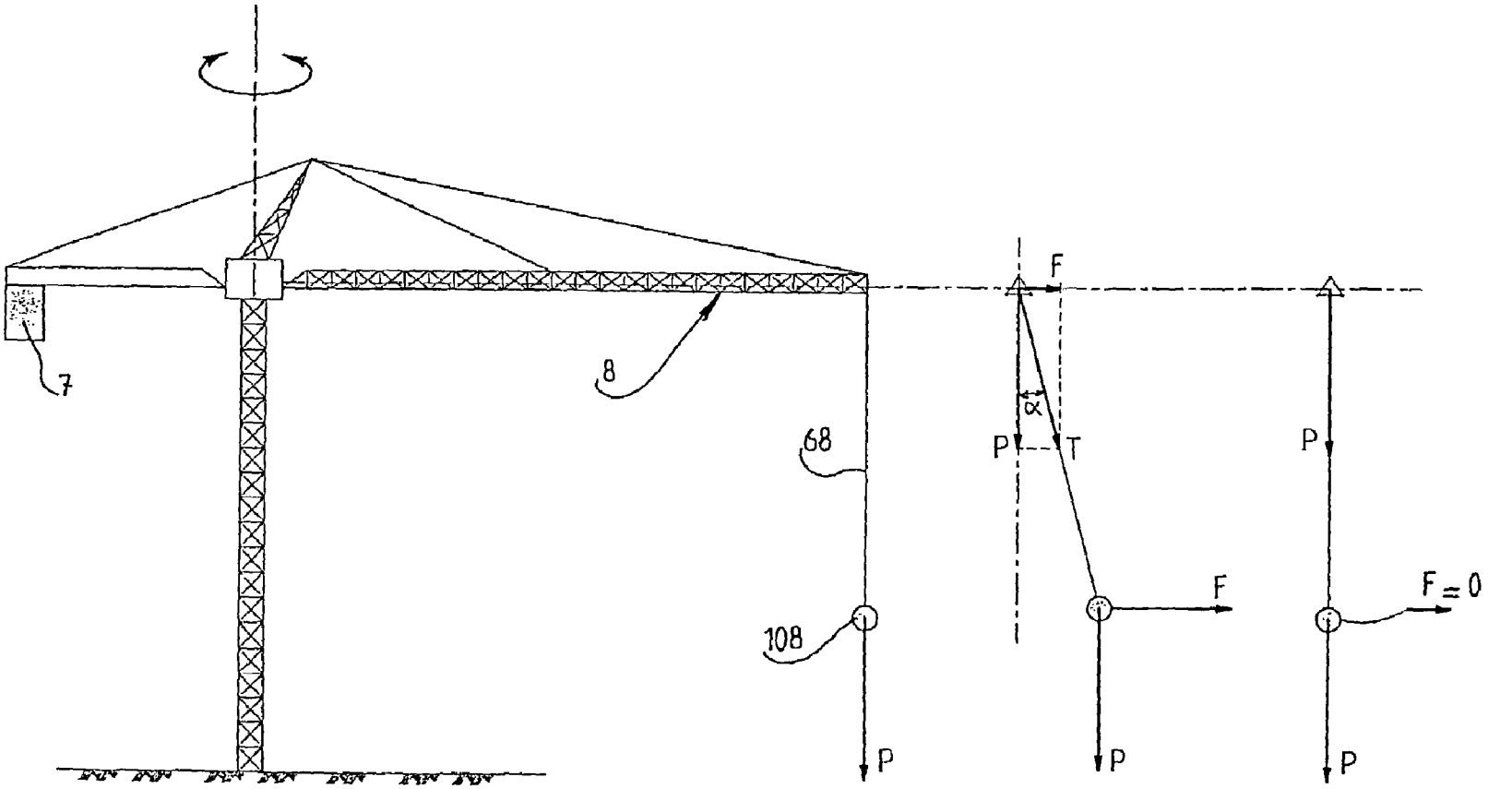

FIG. 8C shows the transfer pipe device according to FIG. 8A in its position of connection to the manifold of the ship;

FIGS. 9A to 9C are diagrammatic views for illustrating the process in which the boom is carried along by the ship.

DETAILED DESCRIPTION

Figure 1:
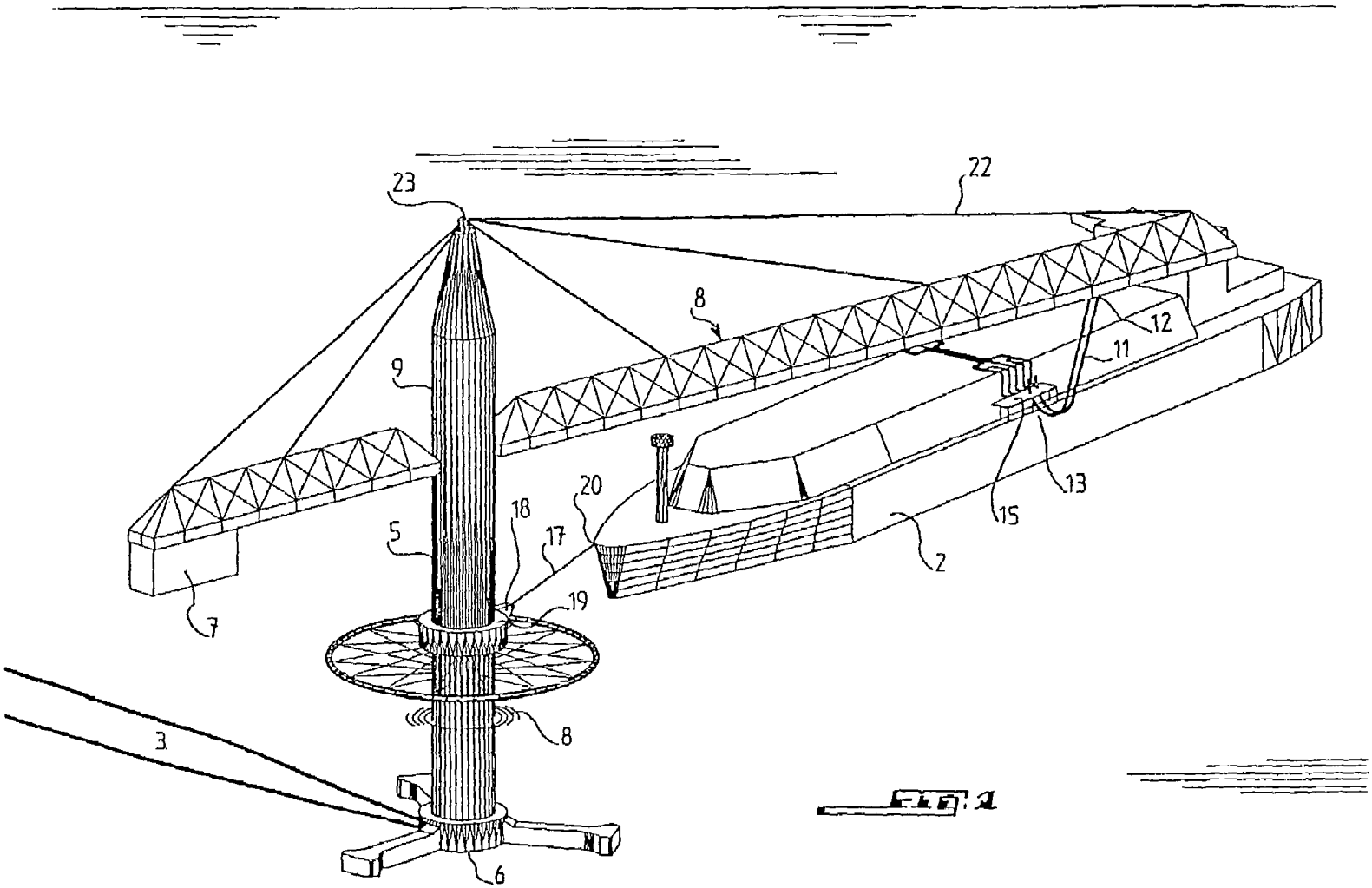
FIG. 1 is an oblique view of a system for transfer of a fluid according to the invention.

FIG. 1 illustrates by way of example a system 1 for transfer of a fluid, in the example, liquefied natural gas (LNG), between transport ship 2 and an installation, for example, a fixed installation for which only submerged cryogenic transfer lines 3 are represented. The transfer system essentially entails mooring post 5, for example, at a coastal site open to the sea, if applicable, at an off-shore site, in the form of a column that rests at 6 on the ocean bottom, and a long horizontal boom 8 mounted on upper emerging part 9 of post 5 and rotatable around its vertical axis, well above ship 2, as well as a deformable tubular device for the transfer of fluid 11, which is connected at one end, indicated by 12, to fixed pipe 10 that extends along boom 8 and through the mooring post and connected to submerged lines 3 by the intermediary of a rotating fluid joint with a vertical axis. The other end 13 of the deformable transfer device can be moved between a storage position at 14 under boom 8 and a position of connection to manifold device 15 of ship 2 located near the longitudinal center of this ship, as in the case of standard liquid natural gas tankers.

Ship 2 is moored by mooring cable 17 to single mooring point 18 of ring 19 which rotates freely around the axis of the mooring post in the form of column 5, cable 17 being attached at front part 20 of the ship.

FIG. 1 moreover shows that boom 8 is, in addition, suspended by support cables 22 from part 23 at the summit of rotating mooring column 9. The static equilibrium of the boom can be obtained by means of counterweight 7 at the end of the "counter" part of the boom that is supported, like the boom, by cables 22, that is to say, the arm of the boom opposite that carrying the transfer device. This structure generally has the advantageous effect of not imparting any fixed end moment to the device for guiding boom 8 in rotation about a vertical axis, which would otherwise appear because of its large overhang.

Boom 8 is motorized so that it can be maneuvered, but it is capable of rotating freely, which allows it to orient itself in the direction of the wind in the storage position. In transfer configuration, it follows ship 2 in its changes of average position that depend in particular on the direction of the wind, of the current, and of the waves. During a transfer of liquefied natural gas between ship 2 and the fixed installation, boom 8 is carried along by the ship via the intermediary of deformable transfer device 11. By making the resultant of the stresses exerted on the boom pass through the neutral axis of the boom, the boom is subjected only to simple bending stress and not to torsional stress. As will be described hereafter, deformable transfer device 11 is realized in such a way as to produce a filtering of the movements of the ship. The small movements of the latter around its average position do not generate sufficient lateral stress to lead to rotation of the boom. Only the changes of average position of the ship lead to rotation. The device "absorbs" the small movements of the ship. Furthermore, the device is capable of absorbing the stress peaks.

With reference to FIG. 9, the principle of entrainment of the boom, constituting an important characteristic of the invention, will be described. This figure diagrammatically shows a counterweight, such as counterweight 108 for example, at the end of stand-off arm 103 according to FIG. 7, suspended from the end of a cable such as cable 68 of this figure, under the end of boom 8. The suspension is done at the site of the neutral axis. When there is a relative lateral movement between the stand-off arm, and thus the counterweight, with respect to the boom, the counterweight, because of its weight P, induces at the site of suspension from the boom by cable 68 a force T that resolves into vertical component P and horizontal component F. In the hypothetical case of negligible friction during rotation of the boom, force component F will move the boom to the point at which this component becomes zero, as seen in FIG. 9C.

A first embodiment of fluid transfer device 11 according to the invention will now be described with reference to FIGS. 3A to 3I. According to this embodiment, the device has three pairs of articulated arms, which are connected in parallel to fixed pipe 10 supported by boom 8, each pair having inner arm 25 and outer arm 26. The two arms are connected to one another by articulation 28 of the type with two rotating joints with perpendicular axes, thus forming a universal joint. The upper end of each inner arm 25 is connected by rotating joint 29 to a limb of E-shaped part 30, whose base is connected by rotating joint 31 to fixed pipe 10.

The axes of rotation of the two joints 29 and 31 are perpendicular. The free end of each outer arm 26 carries connector 33 allowing connection of the arm to manifold 15 of the ship. The connector is joined to the arm by means of two rotating joints 35 with perpendicular axes. Rigidly associated with the connector is centering rod 36, popularly called a "spindle," which is configured to be received in complementary centering funnel 37 which, in the embodiment which is represented, is part of connecting module 38 intended to be interposed, or integral with, the ship, between manifold 15 of the ship and connector 33 of outer transfer arm 26. Connecting module 38 carries, for each arm, winch 39 around which a cable 40 will be wound that passes through funnel 37 and is attached at the end of centering spindle 36. The module is also provided with a device for support on the manifold platform of the ship.

Connecting module 38 which, as seen in the figures, constitutes an extension of the manifolds of the ship, is stored on either the ship or the transfer system. In the latter case, in order for it to be positioned on the manifolds during fluid transfer, the module will be transported to the ship by a service vehicle, for example, or be lowered by a winch from the end of the boom onto the ship.

It should also be noted that, according to the explanations given on the subject of the entrainment of the boom during a fluid transfer, the masses are, as much as possible, brought to the bottom of the inner arm. In order to find an optimum, it will be possible to provide a counterweight at this location as indicated at 41 in FIG. 3B. In order to avoid excessively increasing the counterweight in order to counteract the possible effects of an unfavorable wind, it will be possible to provide the counter-boom with flaps or panels (not represented) that can be adjusted or concealed during transfer for the purpose of balancing the wind loads on the boom and counter-boom (a system neutral with respect to the general axis of vertical rotation).

Figure 3F:
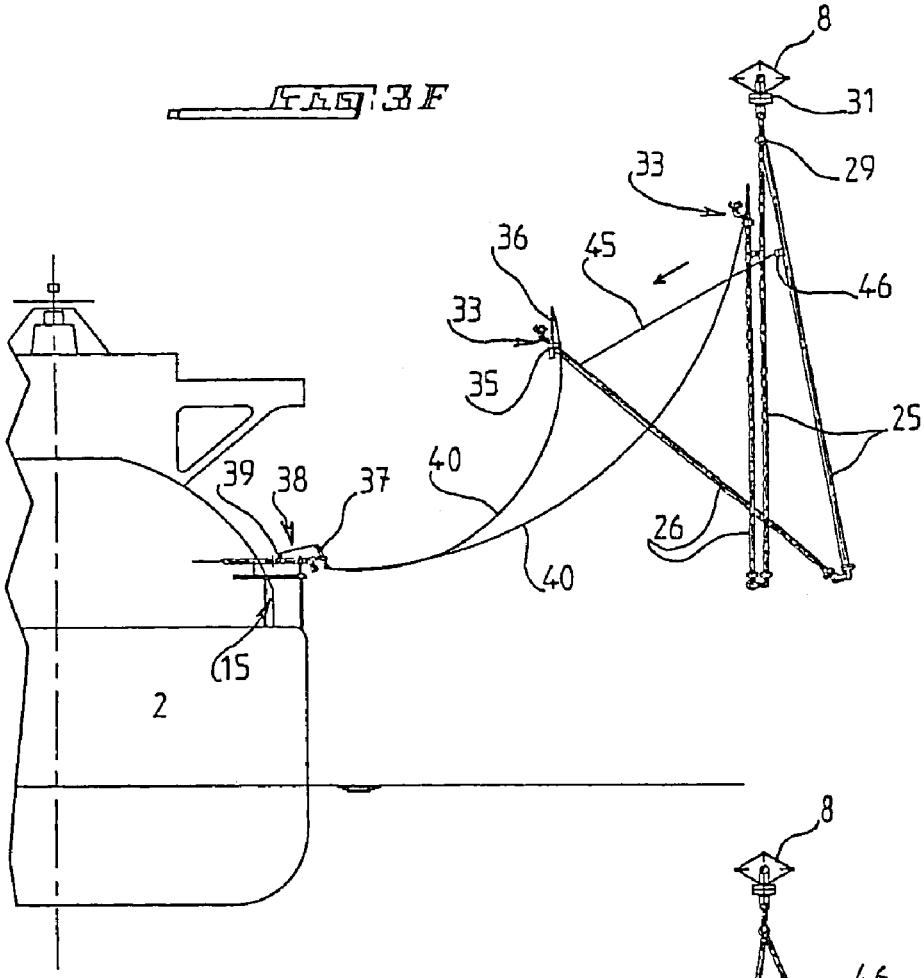
Figure 3G:
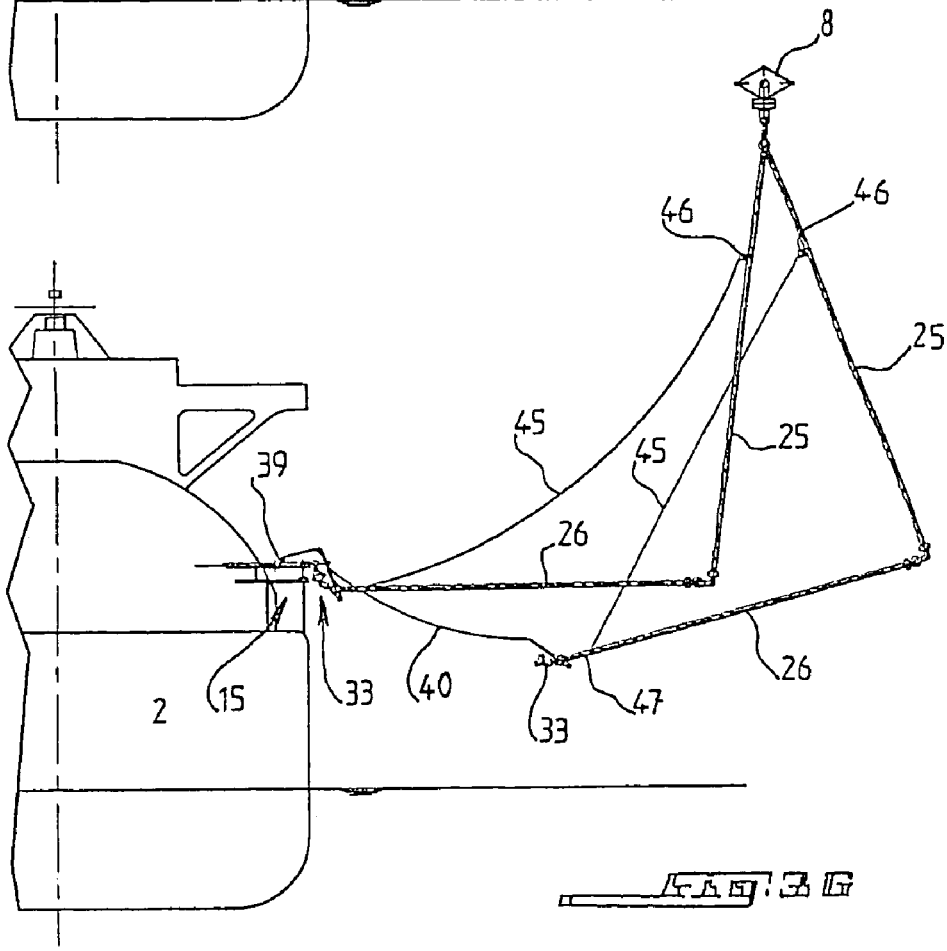

The structure making it possible to maneuver deformable transfer device 11 comprise maneuvering cable 42, which can be wound around winch 43, mounted under boom 8, and whose free end is attached to transfer device 11 at the site of joint 28 between the two arms. This control makes it possible to lower the two arms in a position folded on one another. Another maneuvering cable 45 is provided for unfolding the two arms, one end of cable 45 being windable on or unwindable from winch 46 mounted high on inner arm 25, and the other end of cable 45 being attached at 47 to arm 26 near the free end of the arm 26. The winches can be controlled, in particular remote-controlled, in any appropriate known manner. The rotation of transfer device 11 formed by the three pairs of arms can be controlled, for example, by means of a hydraulic actuator or hydraulic motor, which is not represented. This rotation can also be effected by winching from a service ship. The process for connection of transfer device 11 to manifolds 15 of ship 2 will be described hereafter with reference to FIGS. 3D to 3G. In the resting state or in survival conditions, the device is stored in the folded state under boom 8, maneuvering cables 42 and 45 being wound, respectively, on winches 43 and 46. To make a fluid transfer, transfer device 11 is first lowered by unwinding cable 42 from winch 43. The device then pivots around joints 29, according to FIG. 3D, until it is in its essentially vertical position. Device 11 is then rotated around joint 31 by an angle of 9020 into the position represented in FIG. 3E, wherein the axes of rotation ofjoints 29 are oriented essentially parallel to the neutral axis. Unwinding cable 45 from winch 46 allows arms 25 and 26 to unfold, as seen in FIG. 3F, to the position illustrated in FIG. 3G. Then, after connecting module 38 has been previously mounted or integrated to manifold device 15 of the ship, if applicable, cable 40 attached to the end of the tip of spindle 36 is connected to winch 39 of the connecting module. Given that the cable passes through funnel 37 of the module, winding the cable on the winch, necessarily brings connector 33 to its module connection position, brought about by funnel 37 receiving centering rod 36, even in a "dynamic" mode.

Figure 3H:
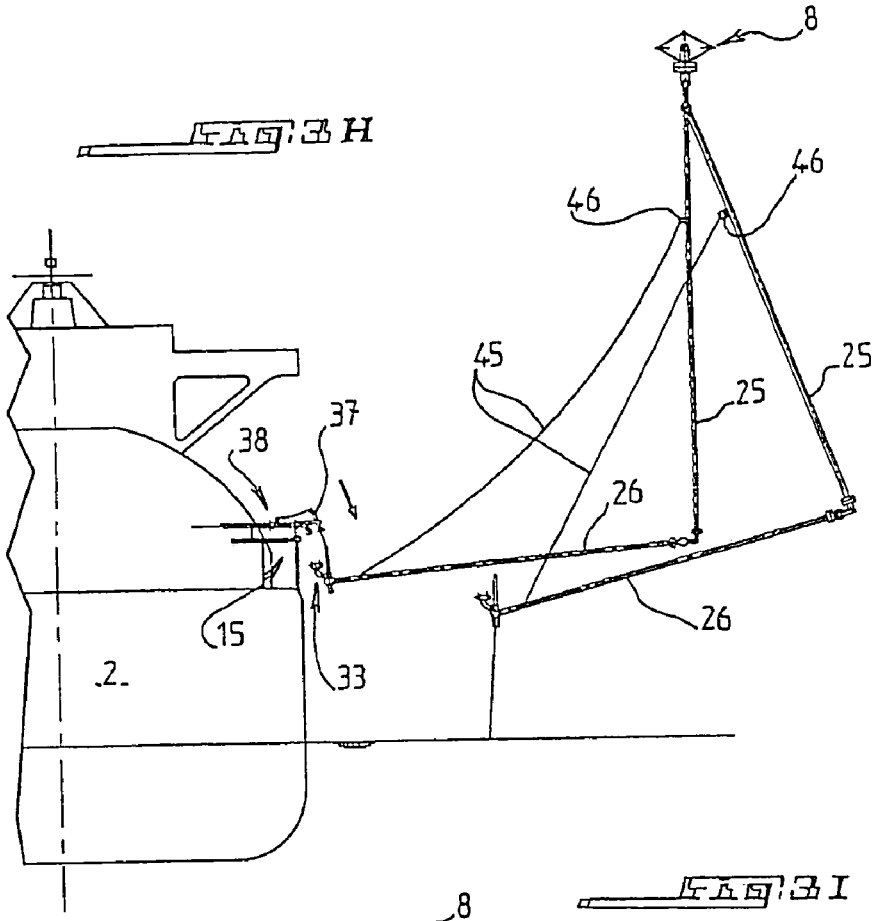
Figure 3I:
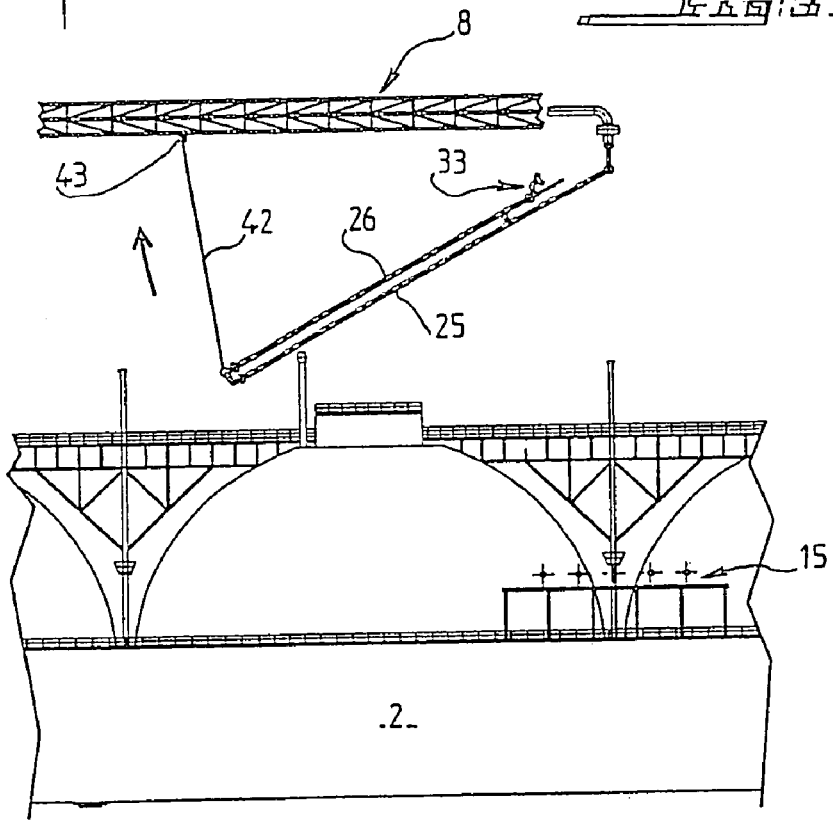

FIGS. 3H and 3I illustrate the process for disconnection of transfer device 11 from connecting module 38, this module remaining on the ship or being brought in any appropriate manner to the transfer system. Unwinding cable 40 from winch 39 enables the separation of connector 33 from the module to the point that cable 40 is unwound and falls in the water. During this disconnection phase (survival or emergency phase), a set torque value for separation of boom 8 from the ship will be given to the system for hydraulic maneuvering of boom 8. Then the folding of arm 26 on arm 25 of deformable transfer device 11 is effected by actuating winch 46, and rotation of the latter around its joint 31U, and raising of the folded device to its storage position according to FIG. 3A is effected by winding cable 42 on winch 43.

A second embodiment of the fluid transfer system according to the invention will be described hereafter with reference to FIGS. 4A to 4P. This embodiment has the particularity, with respect to the embodiment just described, that the deformable transfer device has cryogenic hoses bearing the reference 50. As seen in FIGS. 4A to 4E, the device represented as an example has three hoses 50, mounted in parallel, that are connected to an end of an E-shaped part 30 and are connected to fixed pipe 10 by the intermediary of two rotating joints 31 with perpendicular axes. The cryogenic hoses could be hoses such as those as developed, for example, by the company Coflexip Stena Offshore. The other end of each cryogenic hose carries connector 33, which is provided with a centering rod called a "spindle" 36, and which is intended for mounting on manifold device 15 of the ship, if applicable, via the intermediary of connecting module 38.

Each connector 33 is suspended by a cable 56 which can be wound on winch 57 that is mounted on support cross piece 59, which is itself attached on an arm in the form of a bar 60 that is intended for maintenance of a minimum separation between the ship and boom 8. In effect, when the transfer hoses are arranged in the manner of chains between the end of boom 8 and manifolds 15 as in the present case, the horizontal components of the tensions tend to bring the boom toward the ship. Furthermore, bar 60 participates in putting boom 8 in rotation according to the principle already described. This bar carries, at an end opposite from the end carrying cross piece 59, another cross piece 61 whose exterior longitudinal surface carries projecting elements 63 delimiting between one another three V-shaped seats 64, each intended to receive a hose 50. At each end, cross piece 61 has projecting lateral lugs 65 for keeping the hoses near their seat 64. Stand-off bar 60 is suspended at its front end by cable 67 and at its rear end by two cables 68 from transverse beam 70 that also carries E-shaped part 30 to which the three hoses are connected, each cable 68 extending between an end of beam 70 and an end of crosspiece 61. Each hose is moreover provided, in the part situated between cross piece 61 and part 70, with spacers 72. It is also observed that the front end of stand-off bar 60 carries spindle 74 that is mounted to pivot on two ball joints (three directions of rotation) and is intended to cooperate with complementary funnel 75 mounted on connecting module 38, through a cable 76, which can be wound on a winch 77. The winch 77 is also provided on the connecting module. Of course, this module carries winches for winding the cables for engagement and for maintaining the spindles of connectors 33 in their associated funnel, as in the case of the first embodiment.

Transfer device 11 formed by the set of hoses 50 can be maneuvered by two maneuvering cables attached to the front and rear ends of stand-off arm 60, namely front cable 80 that can be wound on winch 81 mounted under boom 8, and two cables 83 that can be wound on two winches 84 also arranged under the boom. The two winches 81 and 84 are separated from one another in the longitudinal direction of the boom. It is also important to note that arm 60 can be provided, at its rear end, with counterweight 86 according to the principle already described. It is also possible to provide each hose 50 with curvature stiffeners 87 and 88 at, respectively, its upper end and at its intermediate curved part intended to butt against cross piece 61 when the hoses are connected to the manifolds of the ship, as seen in FIG. 4B. It should be noted that depending on the nature and the characteristics of the hoses, they can be used instead of cables 68 as a structural link between beam 70 and cross piece 61, a device for fastening the cross piece to the hoses being provided in that case (but not shown).

FIGS. 4F to 4L illustrate the process of connecting hoses 50 to manifold 15 of ship 2. In their rest position, as seen in FIG. 4A, stand-off bar 61 is held under boom 8 by cables 80 and 83 which are completely wound on their winches 81 and 84. The bar extends parallel to the boom. The hoses are suspended in the manner of chains.

In order to connect the hoses to the manifold of a ship, maneuvering cables 80 and 83 are unwound, as seen in FIGS. 4F and 4G. It can be seen that the curvature of the exterior part of the hoses is limited due to the fact that the hoses butt against cross piece 61 while being engaged in seats 64 provided for this purpose. The engagement ensures a well defined position of the hoses during the remainder of the connecting process and during the period of transfer and of later disconnection. Device 11, that is to say, the set of three hoses is then rotated by an angle of 90°, through rotating joint 31 or two superposed joints, to the position represented in FIG. 4H in which the hoses extend perpendicular to the longitudinal axis of the ship. As seen in FIG. 4I, device 11 of hoses, 50 is pulled, using cable 76 interconnected between the tip of spindle 74 associated with bar 60 and winch 77, towards the connecting module mounted beforehand on manifold 15 of the ship. The engagement of spindle 74 in funnel 75 ensures the correct positioning of transfer device 11. Then suspension cables 56 of connectors 33 of the hoses are unwound from their respective winches 57 and, as described in describing the first embodiment of the transfer device, the connection between the hoses and the connecting modules is ensured. It is observed that bar 61, by being connected to an end of the ship and by holding the hoses at its other end, ensures a suitable separation between the boom and the ship.

According to FIGS. 4M and 4P, disconnection of the hoses takes place in a manner that is the reverse of the connection process just described: first of all by disconnecting the hoses from the connecting modules, then by winding suspension cables 56 of the connectors of the hoses on their winch 57 (FIG. 4M), then by disconnecting stand-off bar 60, effecting a rotation, and finally raising this bar by winding maneuvering cables 80 and 83 on their respective winches 81 and 84.

FIGS. 5A and 5B illustrate a variant of the embodiment represented in FIGS. 4A to 4P. This variant relates to the stand-off arm, which has the general shape of a rectangle, bearing the general reference 90, formed by two longitudinal bars 91 interconnected at the center and at their front and rear ends by respective cross pieces 92, 93 and 94. The cross pieces 93 and 94 respectively fulfill the functions of cross pieces 59 and 61 of the embodiment according to FIGS. 4A to 4P. Hoses 50 now butt directly against rear cross piece 94, and bars 90 and 91 extend beyond cross piece 94 by part 95, bent towards the outside, which can be provided at its free end with counterweight 96.

FIGS. 6A to 6C illustrate another variant of the arrangement for supporting and holding the hoses which has the particularity that stand-off arm 98 is associated with each hose 50, each arm being formed essentially by two longitudinal bars 99 relatively close together and interconnected at the ends and in the middle by cross pieces 100. Each hose is engaged between the two bars 99 of its arm 98. Arm 98 is connected to the end of a hose by a hose end/stand-off arm ball joint connection. The rear end of each bar carries counterweight 101. As seen in FIG. 6B, each arm 99 is suspended from the transverse carrier beam of the shared E-shaped part, to which the cables are connected, by front cable 67 and rear cable 68 extending, in the state of connection of the hoses to the ship, in front of the hoses.

FIG. 7 illustrates another variant of execution of the transfer hose device, according to which the separation between ship 2 and boom 8 is maintained by bar 103 without intermediate support for hoses 50, and which is suspended under the boom as by cables 67 and 68. The rear end of arm 103 carries counterweight 108. In this embodiment, hoses 50 extend freely, in the manner of a chain, between rotating beam 106 and the front end of stand-off arm 103.

FIGS. 8A to 8C illustrate a version of execution of the transfer device 11, which is distinguished from the device according to FIG. 7 essentially by the fact that the points of connection of hoses 50 and of support cables 68 of the stand-off arm are situated at the two ends of arm 110, which is rotatably mounted under boom 8 by rotating joint 31 or two superposed rotating joints. As shown in FIG. 8A, this arm 110 is oriented parallel to the axis of the boom when the transfer device occupies its rest position under the boom, arm 103 then also extending parallel to the boom.

It is observed that the suspension by cable 68 of arms 103 near its middle zone and the counterweight ensure a stable state of equilibrium and moreover make it possible to reduce the maneuvering stresses during connection to the manifolds of the ship, and the stresses on the manifolds or the manifold extensions. Of course, this effect is also produced in a more or less pronounced way in the other embodiments.

It emerges from the description that the invention offers a transfer system that, while having a simple structure, is completely suitable for operation under severe environmental conditions. Thanks to the use of a boom, the transfer system can have a single mooring point while being applicable to ships whose manifolds extend perpendicular to the longitudinal axis of the ship and in its middle (standard liquid natural gas tankers). Of course, these manifolds need not be arranged in the central part of the ship, as in the case which is represented. It should be noted that the transfer system according to the invention can be realized in the form of an off-shore station.

Of course, numerous modifications can be made to the embodiments described and represented without departing from the scope of the invention. Thus, the support of the boom could be installed on a floating support, such as a floating unit for storage or production of liquefied natural gas. In the preceding description, the LNG transfer lines alone were described. It is also possible, of course, to provide a circuit for the return of gas in the form of vapor. In this case, it will be advantageous to use rotating multi-passage coaxial fluid joints in the axis of rotation of the boom in the mooring column. The same is true for joint 31 for connecting the deformable transfer device to the rigid pipe. Concerning joint 31, 360° rotation not being necessary, either rotating single-passage joints on the same axis, or hoses could advantageously be used. Such joints are known, and need not be described here.

In the embodiments described and represented, the deformable transfer devices are connected to the manifold device from below. It would of course be possible to provide transfer devices that are connected to the manifold from above, that is to say, by lowering. In this case, it is sufficient to make the connectors of the transfer device open, if applicable, towards the bottom and the connectors of the manifold device open towards the top, vertically, the spindle and the funnel extending correspondingly, parallel to the axes of the connectors.

In order to give some indications as to the dimensions of the system according to the invention, only as an example, the boom could advantageously have a length between 200 and 220 meters, and its height above the level of the water could be on the order of 50 meters.

It should be noted that an essential characteristic of the invention lies in the fact that during the sensitive phases of connection/disconnection of the deformable transfer device, a single cable executes the functions of support/hoisting of the mobile end of this deformable system and of guiding, in particular, laterally. This single cable is arranged along the axis of the main movements of the ship (heaving).

The invention claimed is:

1. A system for transfer of a fluid product, the system comprising:

a ship having a length and for transporting the fluid product, the ship including a manifold for transfer of the fluid product to and from the ship; and an installation for receiving and supplying the fluid product, the installation comprising:

a mooring post for the ship, the mooring post including a structure having a lower part linked to the earth at the bottom of a body of water navigated by the ship and an upper part, extending above the body of water, and including a column, a boom mounted on the upper part of the structure, having a free end, and rotating about a first vertical axis so that at least part of the boom may be located directly above the ship when moored to the mooring post, a transfer pipe carried by the boom, a deformable transfer device having a first end carried by the boom and connected to the transfer pipe and a second end comprising connection means for connection to the manifold, and means for mooring the ship to the mooring post, wherein the deformable transfer device is movable between a storage position in a storage state and a transfer position in a transfer state, connected to the manifold, with the free end of the boom near the manifold, the means for mooring the ship extends between an end of the ship and the upper part of the structure and rotates freely about the first vertical axis of the structure so that the ship can move freely about the mooring post for alignment with swells and currents of the body of water and with wind, with the end of the ship facing the mooring post, the manifold is located centrally along the length of the ship, and the deformable transfer device turns about a second vertical axis, where the deformable transfer device is attached to the boom, for rotation and movement of the deformable transfer device between the storage position and the transfer position, whereby torsional stress on the boom when the deformable transfer device is in the transfer position is relieved by rotation of the boom about the first vertical axis and rotation of the deformable transfer device about the second vertical axis.

2. The system according to claim 1, wherein the deformable transfer device has a connector connected to the transfer pipe at the free end of the boom, and the connection of the deformable transfer device to the transfer pipe suspends the deformable transfer device under the boom.

3. The system according to claim 1, wherein the boom has a length between 200 and 220 meters, and extends to a height of about 50 meters above the body of water.

4. The system according to claim 1, wherein the deformable transfer device includes at least one cryogenic hose connected at a first end to the transfer pipe, and having a second end carrying the connection means.

5. The system according to claim 4, wherein, in the storage position, the cryogenic hose is suspended at the second end under the boom, and hangs like a chain.

6. The system according to claim 5, wherein the deformable transfer device includes a plurality of the cryogenic hoses joined at ends which are connected to the transfer pipe, each of which carries a connection means at a free end.

7. The system according to claim 5, including a stand-off arm, associated with the cryogenic hose, maintaining a predetermined separation between the ship and the boom during transfer of the fluid product and enabling the boom to rotate.

8. The system according to claim 7, wherein the stand-off arm is connected to the manifold during transfer of the fluid product.

9. The system according to claim 8, wherein the stand-off arm includes arms carrying, at ends opposite from ends that can be connected to the manifold, and means against which the cryogenic hose is supported during transfer of the fluid product.

10. The system according to claim 9, wherein the stand-off arms have cross pieces from which are suspended the connection means of the hoses, each connection means having a centering rod cooperating with a funnel for receiving the rod during establishment of a connection of the hoses to the manifold.

11. The system according to claim 9, wherein the stand-off arms are suspended under the boom by maneuvering cables that can be wound on winches mounted under the boom.

12. The system according to claim 9, wherein the stand-off arms include respective counterweights at opposite ends of the stand-off arms from ends carrying the hoses.

13. The system according to claim 9, wherein the stand-off arms are suspended under the boom by a suspension component forming a balance beam that maintains a distance between the ship and the boom during transfer of the fluid product, and reduces stresses exerted on the connection means during establishment of a connection and during transfer of the fluid product.

14. The system according to claim 13, wherein the suspension component is a separate component and is one of a cable and a connecting rod.

15. The system according to claim 13, wherein the suspension component is provided by the cryogenic hose.

16. A system for transfer of a fluid product between a ship and an installation for receiving or supplying the fluid product, comprising:

a device for transferring the fluid product between the ship and the installation, supported at a first end by a support structure and having a second end for connection to a manifold of the ship, the support structure including a mooring post for the ship, a boom mounted on the mooring post and rotating about a first vertical axis so that at least part of the boom may be located directly above a ship moored to the mooring post, a transfer pipe carried by the boom, and a deformable transfer device having a first end connected to the transfer pipe and a second end which can be moved between a storage position near the boom and a position of connection to the manifold of the ship, and a rotating joint connecting the deformable transfer device to the transfer pipe upon establishing a connection to the manifold of the ship, for rotation into a position perpendicular to a longitudinal axis of the ship, wherein the deformable transfer device is stored under the boom while oriented parallel to an axis of the boom, the deformable transfer device has, at a free end, a connection device for connection to the manifold of the ship, the connection device and the manifold include means for centering during connection of the deformable transfer device to the manifold of the ship, the deformable transfer device has at least one pair of tubular arms which are articulated to one another, including an inner arm connected to the transfer pipe, and an outer arm that carries the connection device on a free end, the connection device includes a centering rod received in a centering funnel associated with the manifold of the ship, the centering rod being engaged in the funnel by a cable interconnecting a tip of the centering rod and a first winch, the cable passing through the funnel, and when stored under the boom, the outer arm is folded onto the inner arm, and further including means for maneuvering the inner and outer arms, including means for lowering the inner and outer arms in a folded position and means for unfolding the inner and outer arms.

17. The system according to claim 16, wherein the means for lowering the inner and outer arms comprises a cable attached to the inner and outer arms at their mutual articulation, and wound on a second winch mounted under the boom.

18. The system according to claim 16, wherein the means for unfolding the inner and outer arms comprises a cable, one end of which is attached to a front part of the outer arm and the other end of which can be wound on a third winch on the inner arm, near a free end of the inner arm.

19. The system according to claim 16, wherein the deformable transfer device has a plurality of pairs of transfer arms, free ends of the inner arms are connected to a shared part connected to the transfer pipe by the rotating.

20. A system for transfer of a fluid product between a ship and an installation for receiving or supplying the fluid product, comprising:

a device for transferring the fluid product between the ship and the installation, supported at a first end by a support structure and having a second end for connection to a manifold of the ship, the support structure including a mooring post for the ship, a boom mounted on the mooring post and rotating about a first vertical axis so that at least part of the boom may be located directly above a ship moored to the mooring post, and a transfer pipe carried by the boom; and a deformable transfer device having a first end connected to the transfer pipe and a second end which can be moved between a storage position near the boom and a position of connection to the manifold of the ship, wherein the deformable transfer device includes at least one cryogenic cryogenic hose connected at a first end to the deformable transfer pipe, and having a second end carrying a connection device, and the cryogenic hose, in the storage position, is suspended at the second end under the boom and hangs like a chain; and a stand-off arm associated with the cryogenic hose, maintaining a predetermined separation between the ship and the boom during transfer of the fluid product and enabling the boom to rotate, wherein the stand-off arm is connected to the manifold of the ship during transfer of the fluid product.

21. The system according to claim 20, wherein the stand-off arm includes arms carrying, at ends opposite from ends that can be connected to the manifold of the ship, and means against which the cryogenic hose is supported during transfer of the fluid product.

22. The system according to claim 20, wherein the deformable transfer device includes a plurality of the cryogenic hoses joined at ends which are connected to the transfer pipe, each of which carries a connection device at a free end.

23. The system according to claim 21, wherein the stand-off arms have cross pieces from which are suspended the connection devices of the hoses, each connection device having a centering rod cooperating with a funnel for receiving the rod during establishment of a connection of the hoses to the manifold of the ship.

24. The system according to claim 21, wherein the stand-off arms are suspended under the boom by maneuvering cables that can be wound on winches mounted under the boom.

25. The system according to claim 21, wherein the stand-off arms include respective counterweights at opposite ends of the stand-off arms from ends carrying the hoses.

26. The system according to claim 21, wherein the stand-off arms are suspended under the boom by a suspension component forming a balance beam that maintains a distance between the ship and the boom during transfer of the fluid product, and reduces stresses exerted on the connection device during establishment of a connection and during transfer of the fluid product.

27. The system according to claim 26, wherein the suspension component is a separate component and is one of a cable and a connecting rod.

28. The system according to claim 26, wherein the suspension component is provided by the cryogenic hose.

* * * * *